US012144474B2

(12) United States Patent
Saxton et al.

(10) Patent No.: US 12,144,474 B2
(45) Date of Patent: Nov. 19, 2024

(54) FOUR IN ONE INFANT BATH TUB

(71) Applicant: FRIDABABY, LLC, Miami, FL (US)

(72) Inventors: Matthew Saxton, Agoura Hills, CA (US); Stella Lee, Los Angeles, CA (US); Maria Level, Miami, FL (US); Samuel Sauceda, El Serino, CA (US); Chelsea Hirschhorn, Miami, FL (US)

(73) Assignee: Fridababy, LLC, Miami, FL (US)

( * ) Notice: Subject to any disclaimer, the term of this patent is extended or adjusted under 35 U.S.C. 154(b) by 287 days.

(21) Appl. No.: 17/836,613

(22) Filed: Jun. 9, 2022

(65) Prior Publication Data

US 2023/0397773 A1 Dec. 14, 2023

(51) Int. Cl.

| | |
|---|---|
| ***A47K 3/02*** | (2006.01) |
| ***A47K 3/024*** | (2006.01) |
| *A47D 1/10* | (2006.01) |
| *A47D 9/00* | (2006.01) |
| *A47D 13/02* | (2006.01) |
| *A47K 3/12* | (2006.01) |

(52) U.S. Cl.

CPC ..... *A47K 3/024* (2013.01); *A47D 1/10* (2013.01); *A47D 9/016* (2022.08); *A47D 13/02* (2013.01); *A47K 3/127* (2013.01)

(58) Field of Classification Search

CPC ..... A47K 3/024; A47K 3/127; A47K 3/074; A47K 3/034; A47K 3/064; A47D 1/10; A47D 9/016; A47D 13/02; A47D 13/027; A47D 13/029; A47D 13/025

See application file for complete search history.

(56) References Cited

U.S. PATENT DOCUMENTS

| | | | | |
|---|---|---|---|---|
| 1,327,295 A | | 1/1920 | Smith | |
| 1,348,250 A | | 8/1920 | Strachan | |
| 1,545,446 A | | 7/1925 | Paulet | |
| D103,216 S | | 2/1937 | Cevasco | |
| 2,358,003 A | * | 9/1944 | De Puy | A47K 3/064 4/572.1 |
| 2,389,362 A | | 11/1945 | Harper | |
| 2,460,308 A | | 2/1949 | Pribil | |
| 2,461,744 A | | 2/1949 | Lafield | |
| 2,487,228 A | * | 11/1949 | Feichtmeir | A47K 3/074 D23/278 |

(Continued)

FOREIGN PATENT DOCUMENTS

| | | |
|---|---|---|
| CN | 207253289 U | 4/2018 |
| CN | 207613685 U | 7/2018 |

(Continued)

*Primary Examiner* — Syed A Islam

(74) *Attorney, Agent, or Firm* — Seyfarth Shaw LLP

(57) ABSTRACT

An infant bathing system has a sling for receiving the body of an infant and a tub into which the sling is installed. A second panel of the sling has a first end that is joined to a second end of a first panel. A third panel has leg holes for the infant and a first end that is joined to the second end of the first panel and to the first end of the second panel. A bar connected to the second end of the third panel is adapted to span the tub and to be installed in channels in the tub walls. In one use configuration, the second panel is positioned above the third panel and occludes the leg holes in the third panel. In another use configuration, the third panel is positioned above the second panel and allows use of the leg holes.

5 Claims, 24 Drawing Sheets

(56) References Cited

U.S. PATENT DOCUMENTS

| | | | | |
|---|---|---|---|---|
| 2,507,848 | A | 5/1950 | Bashaw | |
| 2,531,724 | A | 11/1950 | Cevasco | |
| 2,547,743 | A | 4/1951 | Burr et al. | |
| 2,728,920 | A | 1/1956 | Hylton et al. | |
| 2,836,833 | A | 6/1958 | Carlson | |
| 3,058,122 | A | 10/1962 | Mcdaniel et al. | |
| D202,412 | S | 9/1965 | Muller | |
| D202,691 | S | 11/1965 | Essman | |
| D206,747 | S | 1/1967 | Essman | |
| 3,341,866 | A | 9/1967 | Wright | |
| D224,306 | S | 7/1972 | Anderson | |
| D241,250 | S | 8/1976 | Fotre et al. | |
| 4,216,552 | A | 8/1980 | Gurolnick | |
| D259,274 | S | 5/1981 | Humes | |
| D259,458 | S | 6/1981 | Fuller et al. | |
| D260,281 | S | 8/1981 | Rist | |
| D329,278 | S | 8/1992 | Gallup | |
| 5,172,781 | A | 12/1992 | Hlavinka et al. | |
| D339,631 | S | 9/1993 | Benson-Gilchrist | |
| D350,598 | S | 9/1994 | Wise et al. | |
| 5,361,430 | A * | 11/1994 | Wise | A47K 3/024 4/573.1 |
| D367,521 | S | 2/1996 | Miller | |
| 5,735,000 | A | 4/1998 | Pfaeffle | |
| 5,809,588 | A * | 9/1998 | Angelotti | A47K 3/064 4/572.1 |
| D418,588 | S | 1/2000 | Yang | |
| 6,018,826 | A * | 2/2000 | Yang | A47K 3/064 4/575.1 |
| D422,345 | S | 4/2000 | Dixon | |
| 6,578,209 | B2 | 6/2003 | Lopes et al. | |
| D538,897 | S | 3/2007 | Erli | |
| D551,741 | S | 9/2007 | Erli | |
| 7,994,440 | B2 | 8/2011 | Oseko et al. | |
| D656,226 | S | 3/2012 | Erli | |
| D656,227 | S | 3/2012 | Erli | |
| 8,250,683 | B2 | 8/2012 | Richardson et al. | |
| 8,250,684 | B2 | 8/2012 | Richardson et al. | |
| D689,171 | S | 9/2013 | Morelock et al. | |
| D726,890 | S | 4/2015 | Hasunen | |
| 9,055,847 | B1 | 6/2015 | Flannery et al. | |
| 9,395,234 | B2 | 7/2016 | Cosentino et al. | |
| 9,538,823 | B2 | 1/2017 | Hayes et al. | |
| 9,622,592 | B2 * | 4/2017 | Barron | A47D 5/00 |
| 9,622,622 | B2 * | 4/2017 | Sundberg | A47K 3/06 |
| 9,936,839 | B1 | 4/2018 | Richardson et al. | |
| 9,962,041 | B1 | 5/2018 | Flannery et al. | |
| D847,956 | S | 5/2019 | Kwak et al. | |
| 10,362,906 | B2 | 7/2019 | Papageorge et al. | |
| 10,433,679 | B2 * | 10/2019 | Kwak | F16B 2/22 |
| D882,048 | S | 4/2020 | Carter et al. | |
| 10,743,718 | B2 | 8/2020 | Taylor | |
| D899,137 | S | 10/2020 | Pond et al. | |
| 10,959,538 | B2 * | 3/2021 | Williams | A47D 15/008 |
| 2008/0127408 | A1 | 6/2008 | First et al. | |
| 2008/0295239 | A1 * | 12/2008 | Ristuccia | A47K 3/024 4/589 |
| 2010/0032460 | A1 * | 2/2010 | Hyde | A47D 15/006 224/160 |
| 2010/0207435 | A1 * | 8/2010 | Vered | A47D 1/10 297/256.16 |
| 2014/0201901 | A1 | 7/2014 | Gibree | |
| 2017/0290467 | A1 | 10/2017 | Joseph-Maloney | |
| 2017/0303746 | A1 | 10/2017 | Yeh | |
| 2018/0028023 | A1 | 2/2018 | Allen et al. | |
| 2018/0344097 | A1 | 12/2018 | Gomes et al. | |

FOREIGN PATENT DOCUMENTS

| | | | |
|---|---|---|---|
| CN | 207640289 | U | 7/2018 |
| CN | 216060297 | U | 3/2022 |
| EM | 000329040 | | 6/2005 |
| EM | 001797960 | | 1/2011 |
| EM | 004005007 | | 6/2017 |
| EM | DM/102 915 | | 8/2018 |
| KR | 101584860 | B1 | 1/2016 |
| KR | 102140524 | B1 | 8/2020 |
| NL | 1033953 | | 12/2008 |

* cited by examiner

FOUR IN ONE INFANT BATH TUB

BACKGROUND OF THE INVENTION

Infants grow rapidly into children, and the requirements for bathing them change just as rapidly. As an infant grows in size, the infant also gets better control over his or her body. The body of a newborn infant may be supported by a sling. But in the range of nine to twelve months, the infant starts to learn how to sit up, and this capability is even more firmly established thereafter. So how an infant is bathed changes not only with the infant's size but also with his or her capabilities.

A bathing device, such a small bathtub or even a liner of a sink, may be optimum for a newborn, but not even marginally useful for a much larger and more active two-year old. Ideally infant bathtubs should be reconfigurable so that they may be effectively used over at least the first two years of an infant's life.

Bathing a newborn infant (0-3 months) has an additional requirement: the healing umbilical cord should not be immersed in water, because this increases the chance of infection. Ideally the newborn is suspended such that his or her navel is held above the water level. But, as the infant grows older, it is better to immerse more of the infant in the bath water. A need therefore exists for an infant bathing system that can properly hold a newborn but that can also be reconfigured to receive an older infant.

SUMMARY OF THE INVENTION

According to one aspect of the invention, a convertible sling for supporting an infant includes a first panel formed of flexible material and having a first end and an opposed second end. At least one fastener is connected to the first end for fastening it to a support, such as the rim of a bathtub. A second panel has a first end that is joined to the second end of the first panel. A third panel, formed of flexible material, has first and second spaced-apart leg holes formed in it. A first end of the third panel is joined to the second end of the first panel and to the first end of the second panel. An attachment mechanism is connected to a second end of the third panel for attaching the second end of the third panel to a support, such as a bathtub. In a first use configuration, a first surface of the first panel and a first surface of the second panel face upward to receive the body of the infant, and the third panel is disposed below the second panel. In a second use configuration, a second surface of the first panel faces upward to receive the body of the infant, and the infant's legs are extended through the leg holes of the third panel. In this configuration, the second panel is disposed below the third panel.

In one embodiment, and in the first use configuration, the second panel is supported by the third panel, with a second surface of the second panel lying against a first surface of the third panel and occluding the leg holes in the third panel. In one embodiment, the first and second panels are manufactured as a continuous piece of flexible material.

In one embodiment, the attachment mechanism comprises a flexible sleeve formed on the second end of the third panel. A rigid bar is inserted through this sleeve. The bar has opposed, first and second bar ends, which are adapted to be attached to respective supports. In one embodiment, the bar ends have flanges that fit into channels in the supporting structure.

In one embodiment, the fastener is one of a pair of fasteners, each of which terminates in a hook for fastening to a support, such as a rim of a bathtub.

In another aspect of the invention, an infant bathing system comprises an elongate tub and a convertible sling for supporting an infant. The tub has a circumferential sidewall that downwardly extends from a rim of the tub to a bottom of the tub. The circumferential sidewall includes opposed first and second walls. A first channel is formed in the first wall to have an open upper end near the rim. Similarly, a second channel is formed in the second wall to have an open upper end near the rim. The sling has first, second and third panels. The first panel has a first end, an opposed second end, and opposed first and second surfaces extending from the first end to the second end. At least one fastener is connected to the first end of the first panel to fasten it to the rim of the tub. The second panel has a first end joined to the second end of the first panel and an opposed, free, second end. In one embodiment, the first and second panels may be manufactured as a continuous piece of flexible material. Opposed first and second surfaces of the second panel extend from the first end to the second end thereof. The third panel is formed of a flexible material and has opposed first and second ends. Opposed first and second surfaces of the third panel extend between the first and second ends of the third panel. First and second spaced-apart leg holes are formed to extend through the third panel. The first end of the third panel is joined to the second end of the first panel and to the first end of the second panel. A bar is connected to the second end of the third panel. Opposed first and second bar ends are adapted to be received in the first channel or the second channel. In a first use configuration, the first surface of the first panel and the first surface of the second panel face upward to receive the body of the infant, and the third panel is disposed below the second panel. In a second use configuration, the second surface of the first panel faces upward to receive the body of the infant and the infant's legs extend through the leg holes of the third panel. In this second use configuration, the second panel lies on the floor of the tub.

In one embodiment, the first and second channels are positioned closer to the second end of the tub than they are to the first end of the tub. In the first use configuration, the first end of the first panel is fastened to the first end of the tub. In the second use configuration, the first end of the first panel is fastened to the second end of the tub.

In one embodiment, a third channel is formed in the first wall of the tub and a fourth channel is formed in the second wall of the tub. The third and fourth channels are closer to the first end of the tub than are the first and second channels, and their respective bottoms are lower. In a third use configuration, the bar ends are inserted into the third or fourth channels.

In one embodiment, a fourth use configuration is obtained simply by removing the sling altogether—the now-older infant simply sits in the tub.

In another aspect of the invention, an infant bathing system includes a tub with a bottom and a rim disposed at a predetermined height from the bottom. A sidewall of the tub extends from the bottom to the rim. The system further includes a support for supporting the infant. Means are provided for attaching the support to the rim or to the sidewall in any of a plurality of use configurations, including first and second use configurations. In the first use configuration, a seat of the infant is supported in the tub by the support at a first depth from the rim. In the second use configuration, the seat of the infant is supported in the tub by the support at a second depth of from the rim, the second depth being greater than the first depth. In one embodiment, the second depth is less than the predetermined height of the rim.

In one embodiment, the support is a flexible sling. The tub is elongate and has first and second opposed ends. The tub sidewall includes first and second opposed sidewalls, each of which extends between the first and second ends of the tub. The sling has a first end for attachment to one of the ends of the tub and a second end for attachment to each of the first and second sidewalls of the tub. In the first use configuration, the second end of the sling is attached to each of the first and second sidewalls at a third depth that is less than or equal to the first depth. In the second use configuration, the second end of the sling is attached to each of the first and second sidewalls at a fourth depth that is greater than the third depth and less than or equal to the second depth.

Thus, the provided infant bathing system is reconfigurable to accommodate infants of various sizes and at various stages of development. This obviates the problem of purchasing baby bath tubs or sink liners having only a limited window of utility, after which other baby bath tub(s) must be substituted.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
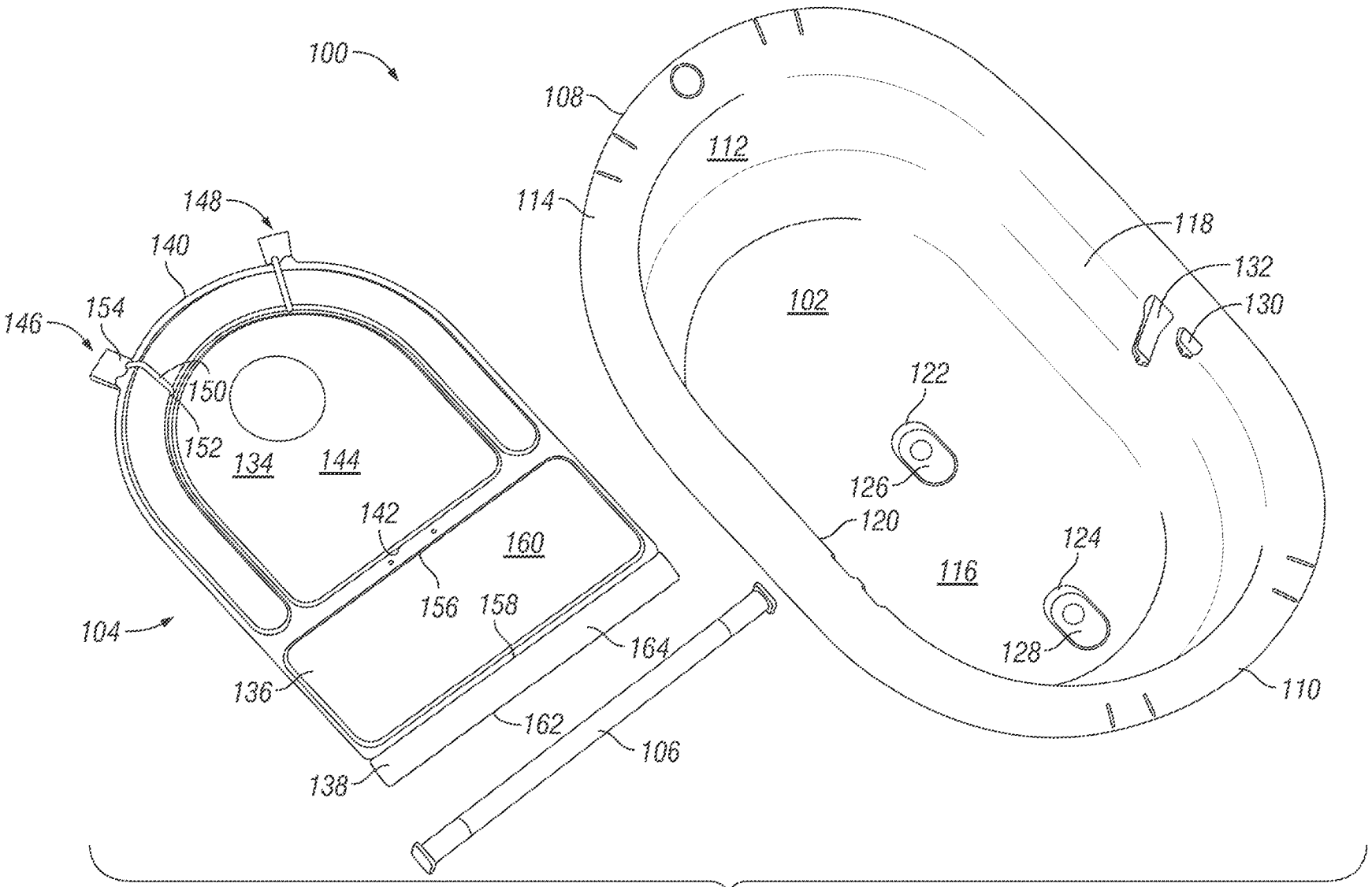
FIG. 1 is a top perspective of an infant bathing system according to the invention, prior to assembly.

In FIG. 1, an infant bathing system 100 appears in a disassembled condition. The system includes an infant bath tub 102, a sling 104 and a bar 106 that in use is a portion of the sling 104 and is a means for attaching an end of the sling 104 to the sidewalls of the tub 102.

In one embodiment the tub 102 is integrally injection-molded from a thermoplastic such as polypropylene. The tub 102 is longer than it is wide and has a first end 108 and an opposed second end 110. An endless, circumferential sidewall 112 downwardly extends from a rim 114 to a floor 116. The sidewall 112 includes two opposed sidewalls 118 and 120 which face each other and which are substantially parallel to the tub 102's long axis. The rim 114 can be upwardly convex. Tub floor 116 may include one or more drain holes 122, 124, into which may be fitted elastomeric drain plugs 126, 128.

Tub 102 should be sized to receive an infant who is up to 24 months old. In the illustrated embodiment, tub 102 is about 73 cm long, about 45 cm wide, and about 19 cm deep. The tub rim 114 can be disposed at a height of about 17 cm above the tub floor 116.

A relatively short channel or slot 130 is formed in sidewall 118. Channel or slot 130 is positioned closer to end 110 than it is to end 108. In the illustrated embodiment, channel 130 is about 25 cm from end 110 and is about 46 cm from end 108. An upper end of channel 130 is open and is disposed in or near rim 114. Spaced from channel 130 is a relatively longer, vertically oriented channel 132. Channel 132 is slightly farther away from end 110 than is channel 130, and is slightly closer to end 108. For example, channel 132 may be positioned about 29 cm from tub end 110, and about 42 cm from tub end 108. An upper end of channel 132 is open and is disposed in or near rim 114. Corresponding channels are formed in sidewall 120, but they are not visible in FIG. 1.

The sling 104 is formed mostly of panels of flexible material. The sling 104 has a first panel 134, a second panel 136 that may be continuous with first panel 134, and a third panel 138. Panel 134 has a curved first end 140 and an opposed second end 142. A first surface 144 of panel 134 is oriented to face upward in this FIGURE and extends from first end 140 to second end 142. The shape of curved first end 140 may be chosen to conform to either of curved tub ends 108 and 110. At least one, and in the illustrated embodiment two, fasteners 146 and 148 are connected to first end 140 and are adapted to fasten first end 104 to either tub end 108 or tub end 110. In the illustrated embodiment, each fastener 146, 148 is made up of a cord 150 that passes through a hole 152 in the panel 134 near end 140, and, connected to cord 150, a hook 154. Hook 154 may be plastic. In the illustrated embodiment, the hooks 154 snap over the tub rim 114. Other fasteners could be used in the place of hooks 154; for example, elongate fabric ties or ends could be attached to or formed with first panel 134 to outwardly extend from panel end 140, and these ties or ends could be equipped with snaps that snap to mating snaps located at the tub rim 114. Other fastening systems could be used instead.

The second panel 136 has a first end 156 joined to end 142 of first panel 134. In one embodiment, first and second panels 134 and 136 may be a continuous laminate, as shown, with panel 138 joined to this laminate as by sewing. The second panel has a second, opposed, free end 158, and a first surface 160 that extends between ends 156 and 158 and which in this view is facing upward.

Most of the third panel 138 is not visible in FIG. 1, since panel 136 is lying on top of it. Panel 138 has a first end (not shown here) connected to end 142 of panel 134 and connected to end 156 of panel 136. A second end 162 of the third panel 138 terminates in a sleeve 164, into which will be inserted the bar 106.

Figure 2:
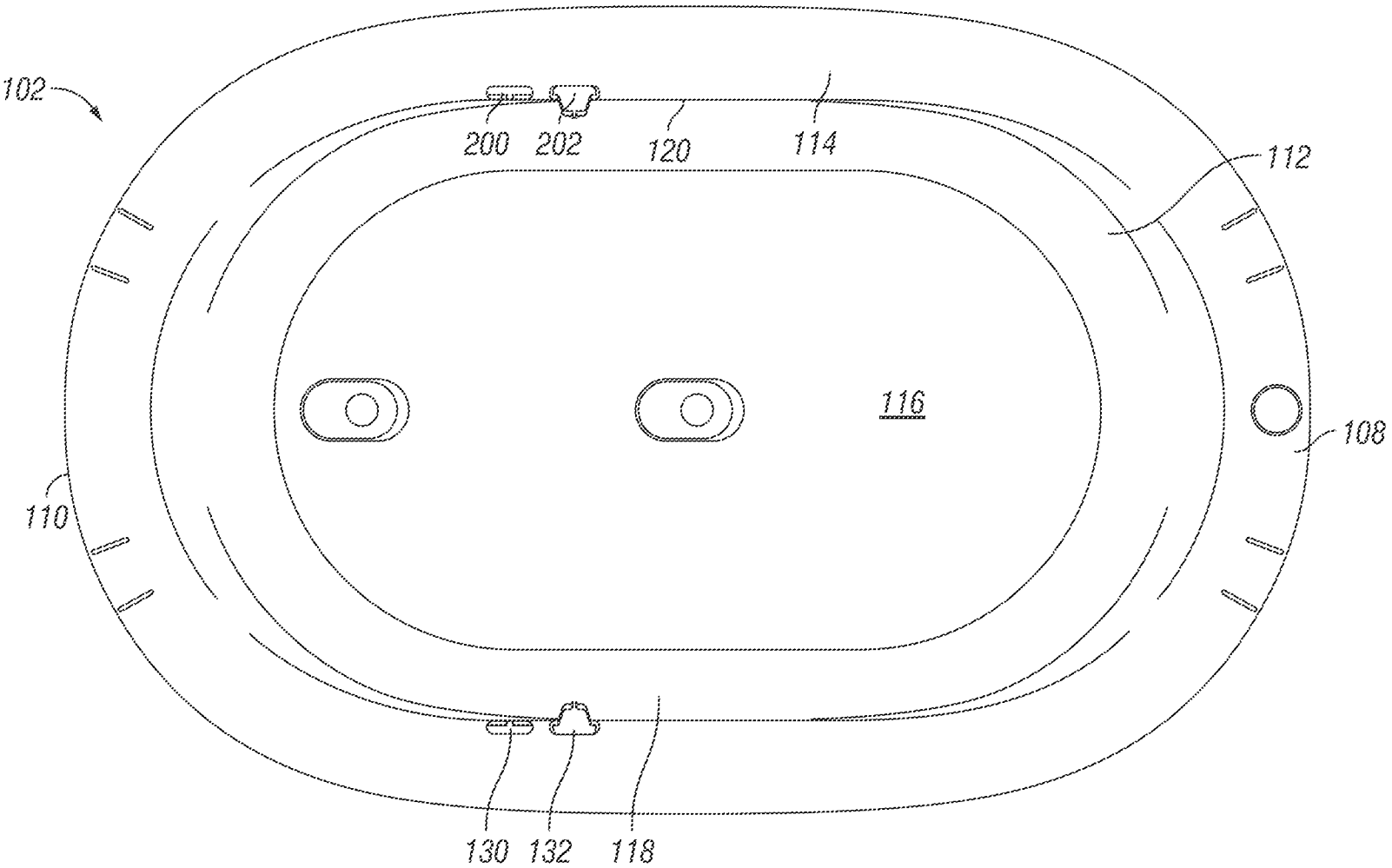
FIG. 2 is a top view of the bath tub seen in FIG. 1.

As seen in FIG. 2, a short channel or slot 200 is formed in sidewall 120 to be closer to tub end 110 than tub end 108. A longer, vertically oriented channel or slot 202 is formed in sidewall 120 to be spaced from channel 200, to be closer to end 108, and to be farther away from end 110. In the illustrated embodiment, channel 200 is similar in form and longitudinal position to channel 130, and channel 202 is similar in form and longitudinal position to channel 132. In the illustrated embodiment, respective ends of the bar 106 will be fitted into channels 130, 200 in two of the use configurations, and will be fitted into channels 132, 202 in another of the use configurations.

Figure 3:
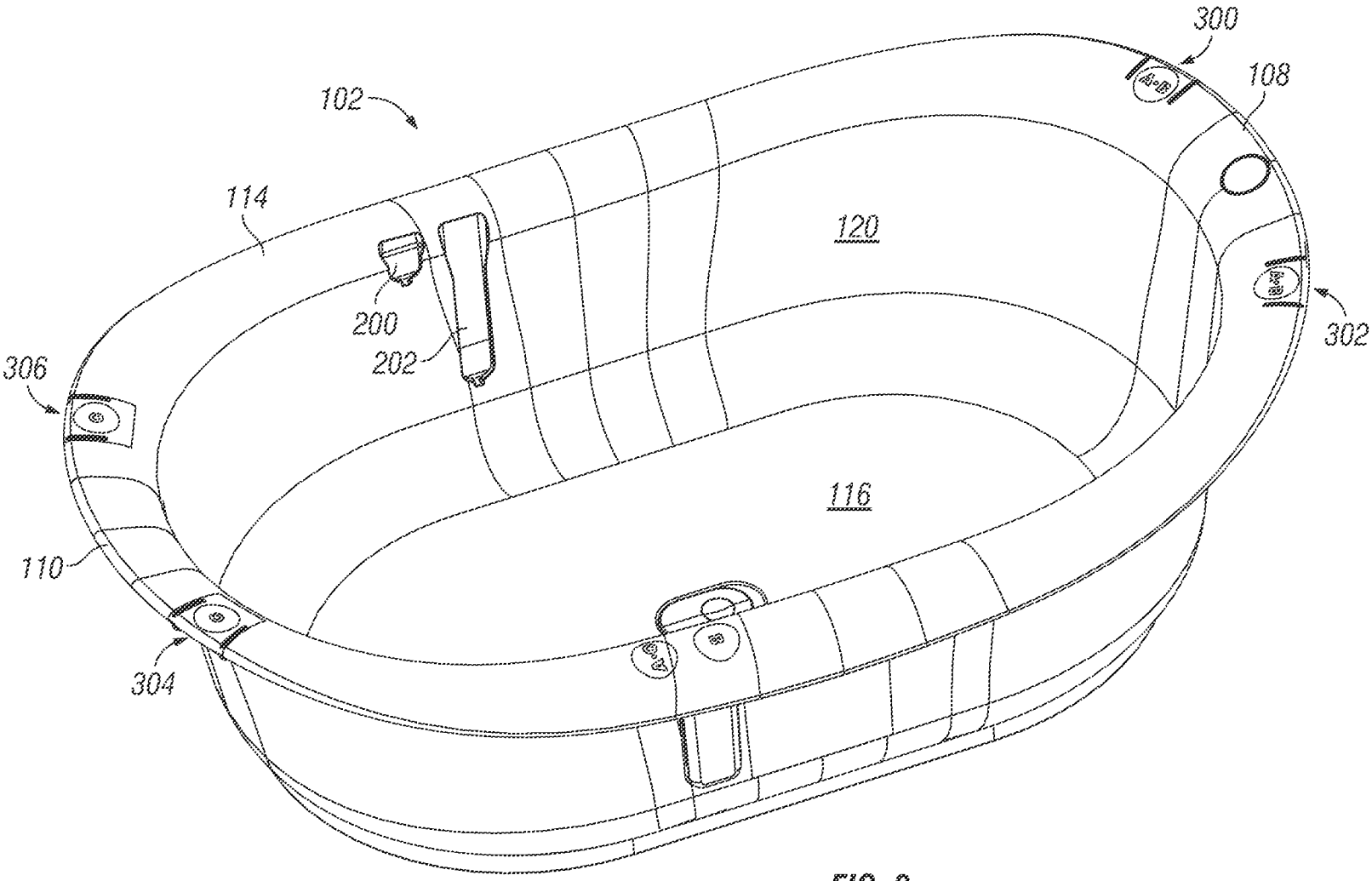
FIG. 3 is a top perspective view of the bath tub illustrated in FIG. 1.
Figure 4:
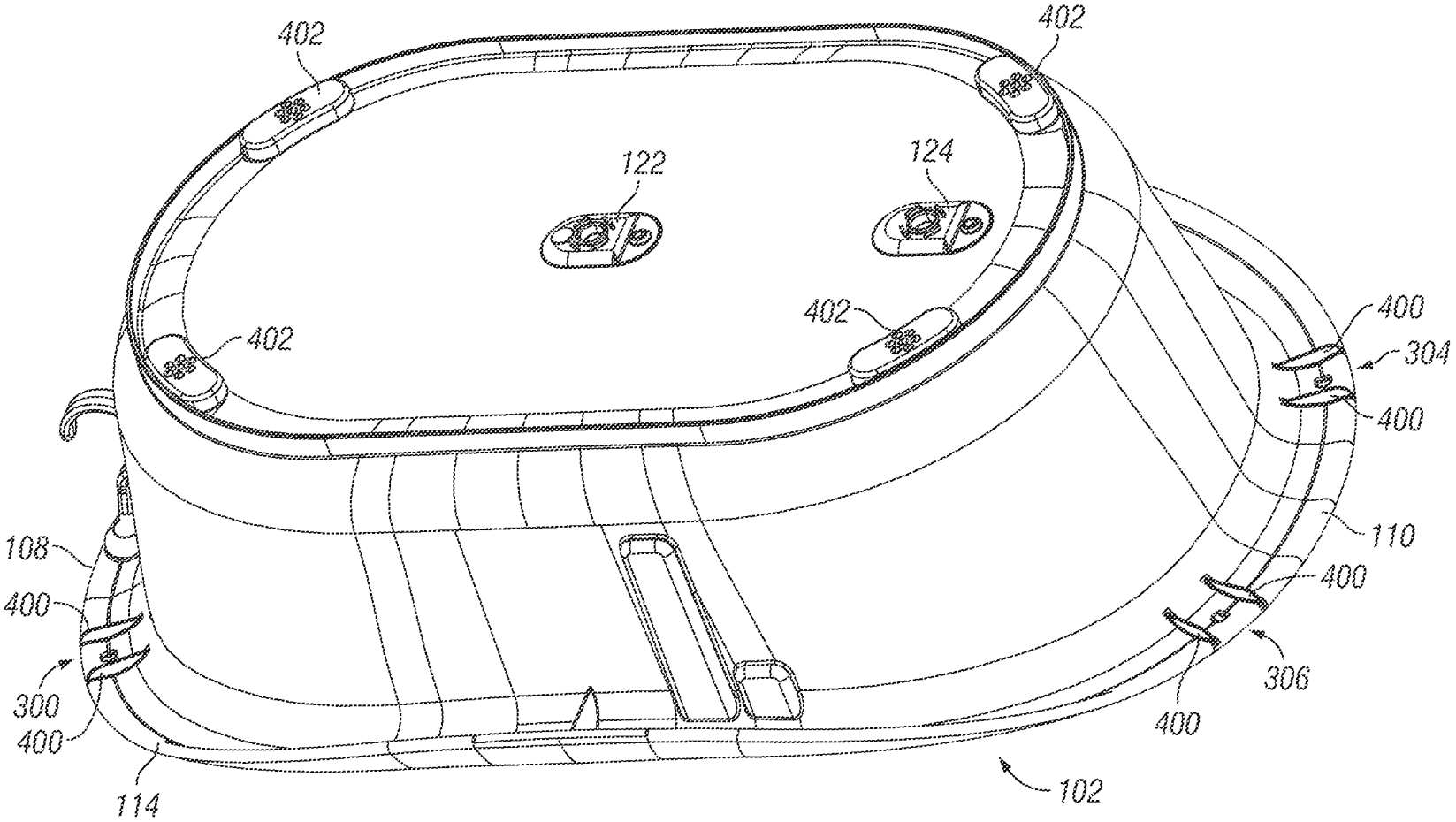
FIG. 4 is a first bottom perspective view of the bath tub shown in FIG. 1.
Figure 5:
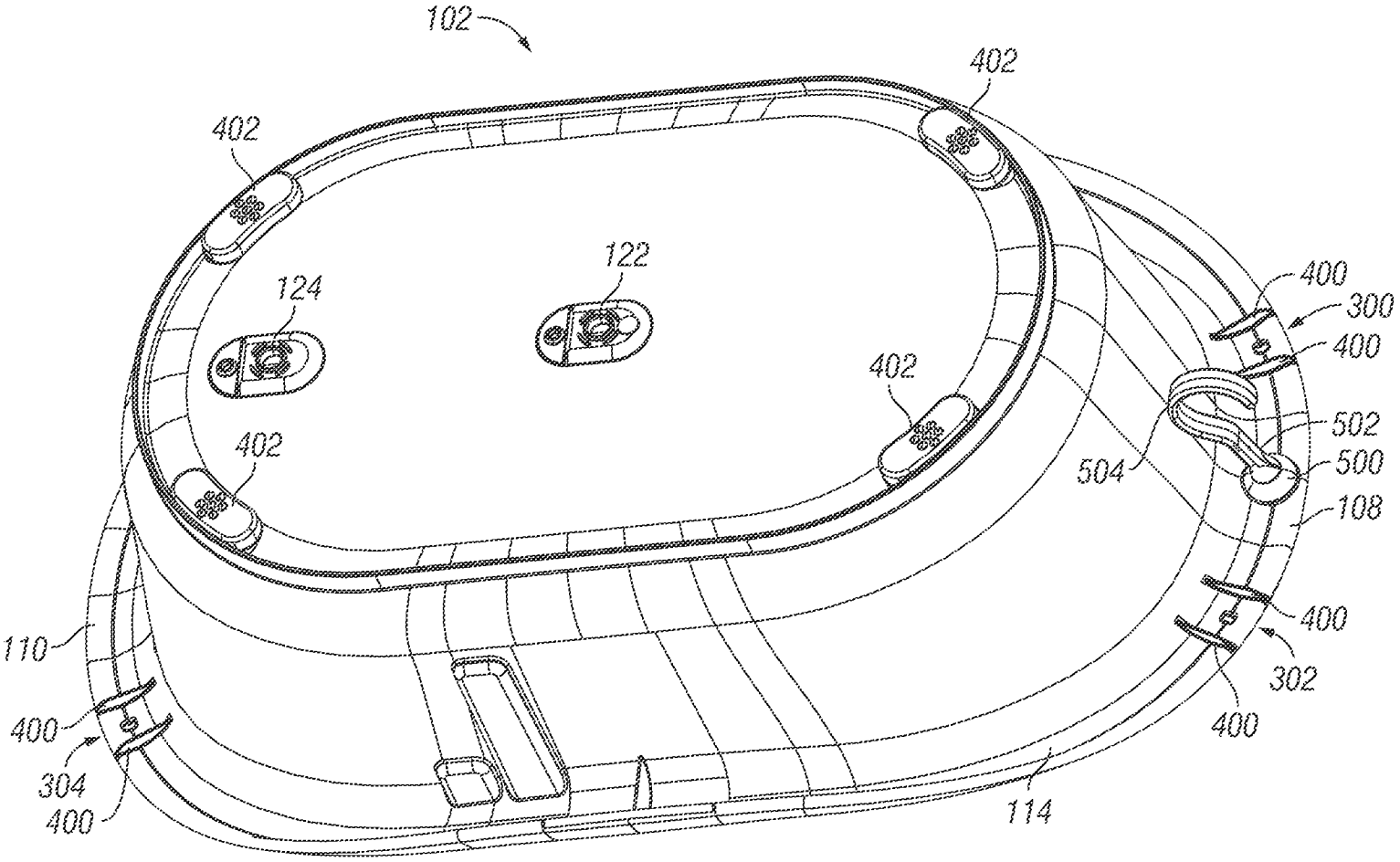
FIG. 5 is a second bottom perspective view of the bath tub shown in FIG. 1.

As seen in FIG. 3, tub end 108 has hook positions 300 and 302 marked on rim 114. Tub end 110 has hook positions 304 and 306 marked on rim 114. Hooks 154 will be installed at positions 300 and 302 in the first and second use configurations, while positions 304 and 306 will be used in the third use configuration. Each of the hook positions 300-306 has a pair of guide fins 400 (FIG. 4), on the underside of rim 114, to guide the hook 154 to the right position on the rim 114. The guide fins 400 also help reinforce and rigidify rim 114. Corresponding fins may be provided on the upper surface of rim 114 as a visual aid to the user. As seen in FIGS. 4 and 5, the bottom of tub 102 may be equipped with elastomeric feet 402, which can be overmolded onto tub 102 by using a thermoplastic elastomer and which are suitably spaced from each other. Feet 402 will mitigate any tendency of the tub 102 to laterally shift while in use.

As seen in FIG. 5, end 108 is equipped with a storage hook 500. The hook 500 has an elastomeric component 502 that is molded or press-fit into a hole in rim 114. The elastomeric component 502 may be twisted about its own axis, and is durable enough that it will not fail as so twisted, even with the rest of the weight of tub 102 dangling from it. A rigid plastic portion 504 is joined to the elastomeric portion 502 and terminates the hook 500.

Figure 6:
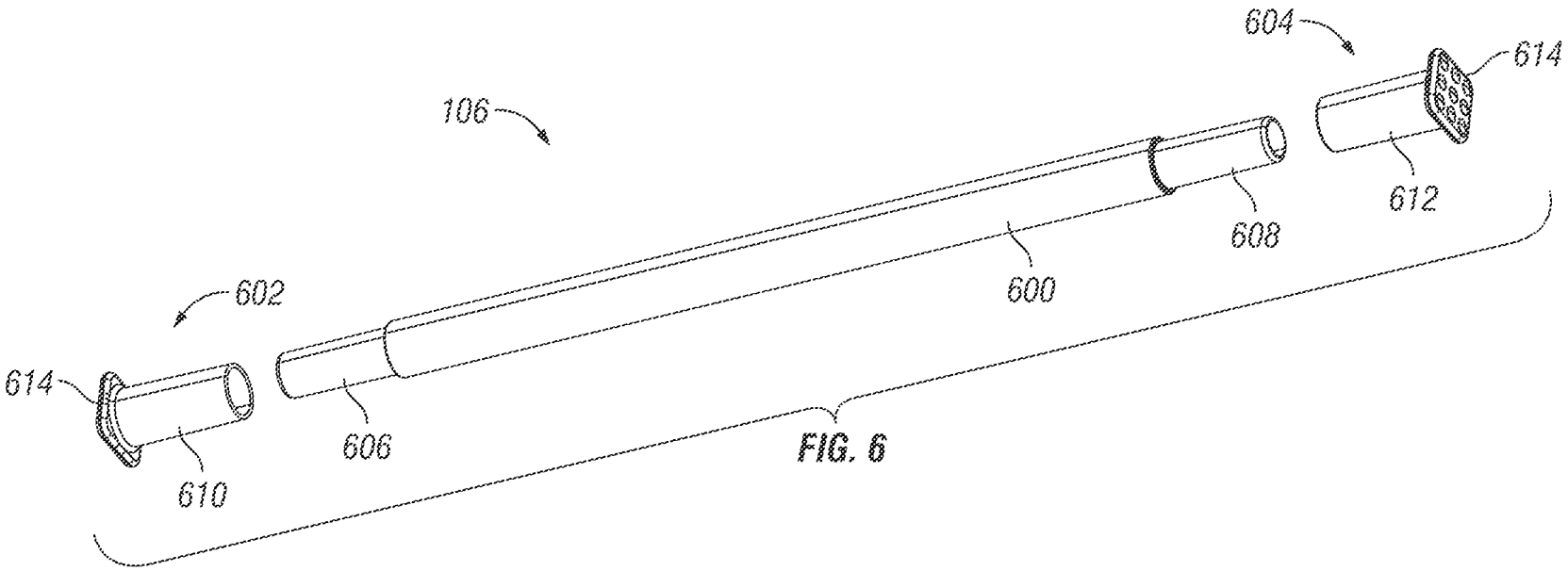
FIG. 6 is an exploded perspective view of a bar for use with the invention and as seen in FIG. 1.

As shown in FIG. 6, the bar 106 may be formed from a tube 600, which can be formed of a metal such as aluminum or stainless steel or a relatively rigid plastic, and opposed bar ends 602 and 604. The tube 600 may have its ends 606, 608 necked to a smaller diameter so that cylindrical portions 610, 612 of bar ends 602, 604 may be pressed onto them. Each bar end 602, 604 terminates in a flange 614 of an enlarged radius relative to the cylindrical portions 612. In the illustrated embodiment, the flanges 614 are square.

Figure 7:
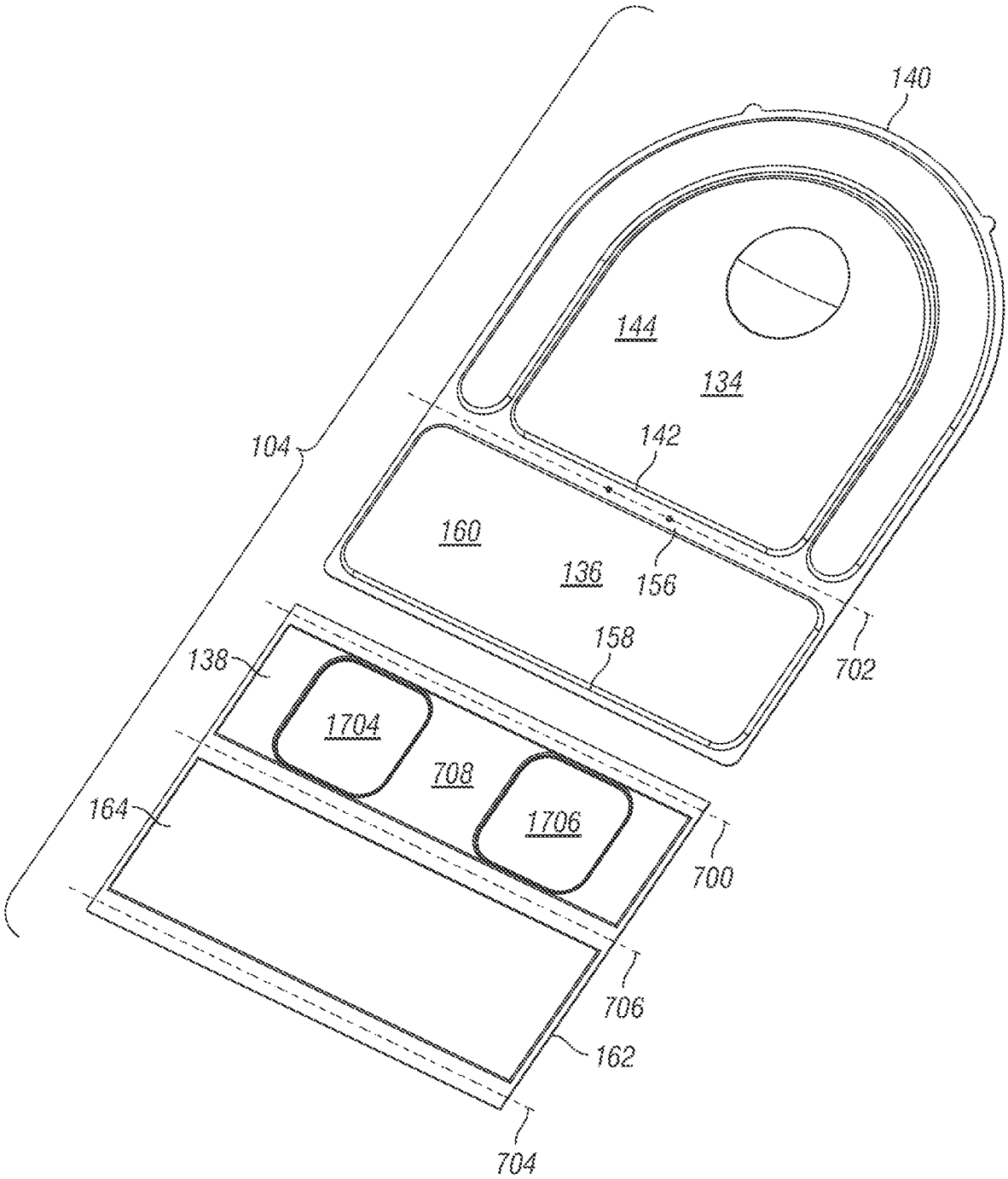
FIG. 7 is a perspective view of two subassemblies of a sling for use with the invention, and shown in FIG. 1.

FIG. 7 illustrates sling 104 at an intermediate step of manufacture. In the illustrated exemplary embodiment, panels 134 and 136 are manufactured as a single unit, such that second end 142 of the panel 134 is continuous with the first end 156 of the panel 136. In one method of manufacture, a uniformly thick layer of EVA foam is jacketed on both sides by spandex. Then the workpiece is molded under heat and pressure until distinct padded areas are formed, as shown. The margins of panel workpiece 134/136 and panel 138 are then trimmed to the shapes shown in FIG. 7. In this embodiment the panel 138 has a first end 700 that is joined, as by stitching, to panel ends 142 and 156 at stitch line 702. The stitching is done such that when completed the panel 138 will underlie panel 136 in this view. The sleeve 164 is completed by stitching end 704 to a stitch line 706. Panel 138 has a surface 708 which, in the first and second use configurations, will be adjacent to and occluded by panel 136, and leg holes 1704 and 1706 for use by the infant when the infant bathing system is in the third configuration.

The sling 104 could be manufactured otherwise. For example, first panel 134 could be made as continuous unit with third panel 138, and second panel 136 then attached as by sewing to the first panel/third panel unit. Or, all three panels 134, 136 and 138 could be initially formed as separate pieces, and could have their respective ends stitched together at stitch line 702.

Figure 8:
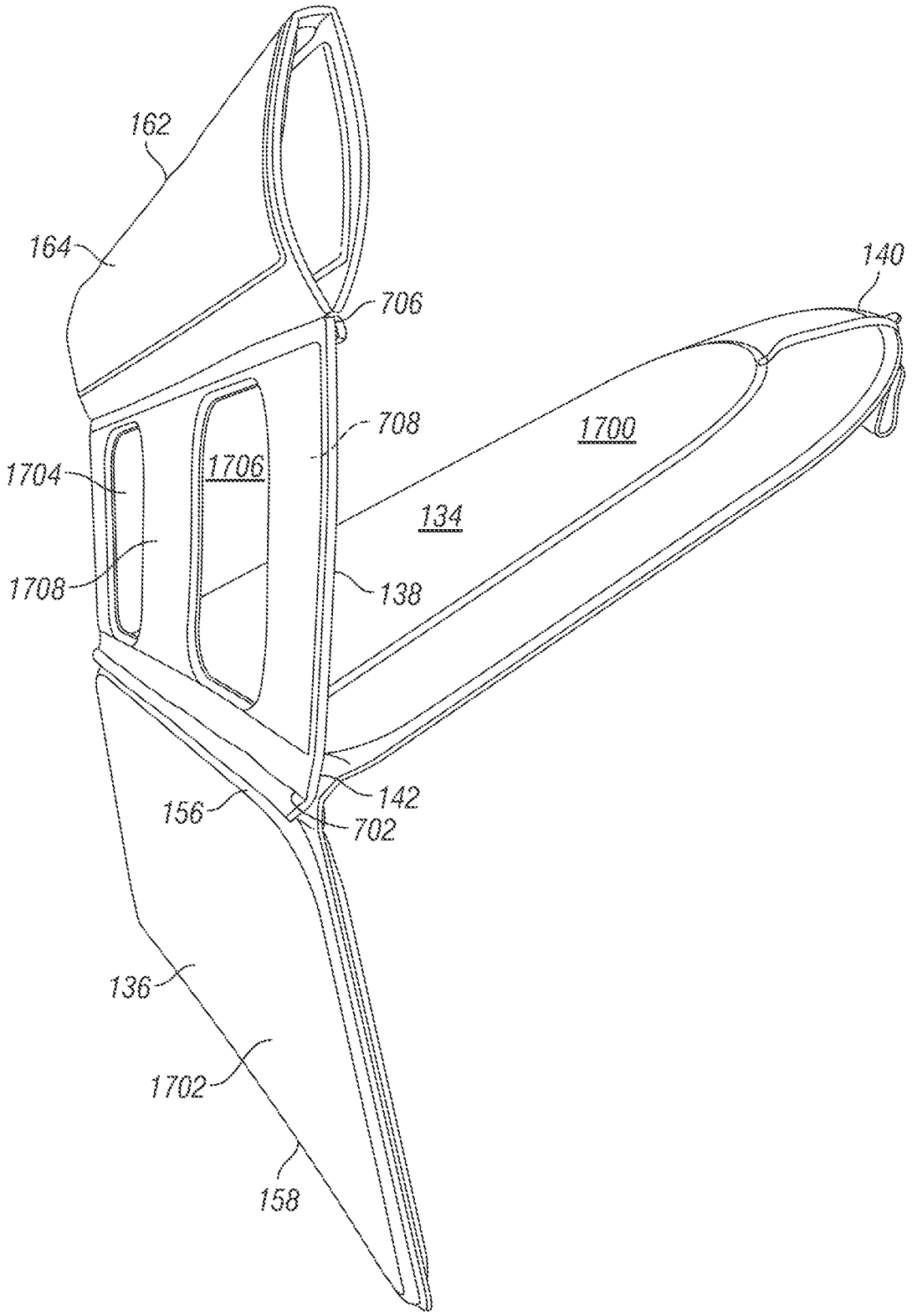
FIG. 8 is a perspective view of the sling shown in FIG. 7, after joining the two subsassemblies together and after creation of the sleeve.

FIG. 8 is an isometric view of sling 104, showing its three panels 134, 136 and 138 splayed out in different directions for purposes of illustration. Panel 134 has a surface 1700 that will face downward in the first and second configurations, but upward in the third configuration. Panel 136 has a surface 1702 that will lie next to surface 1708 of panel 138 in the first and second configurations, but which may face upwards in the third configuration when panel 136 is lying on the tub floor. Surface 708 of panel 138 faces away from the infant in the first and second configurations, but faces toward the infant in the third configuration. Contrariwise, surface 1708 of panel 138 faces toward the infant in the first and second configurations (but will be mostly covered by panel 136), but will face away from the infant in the third configuration.

Figure 9:
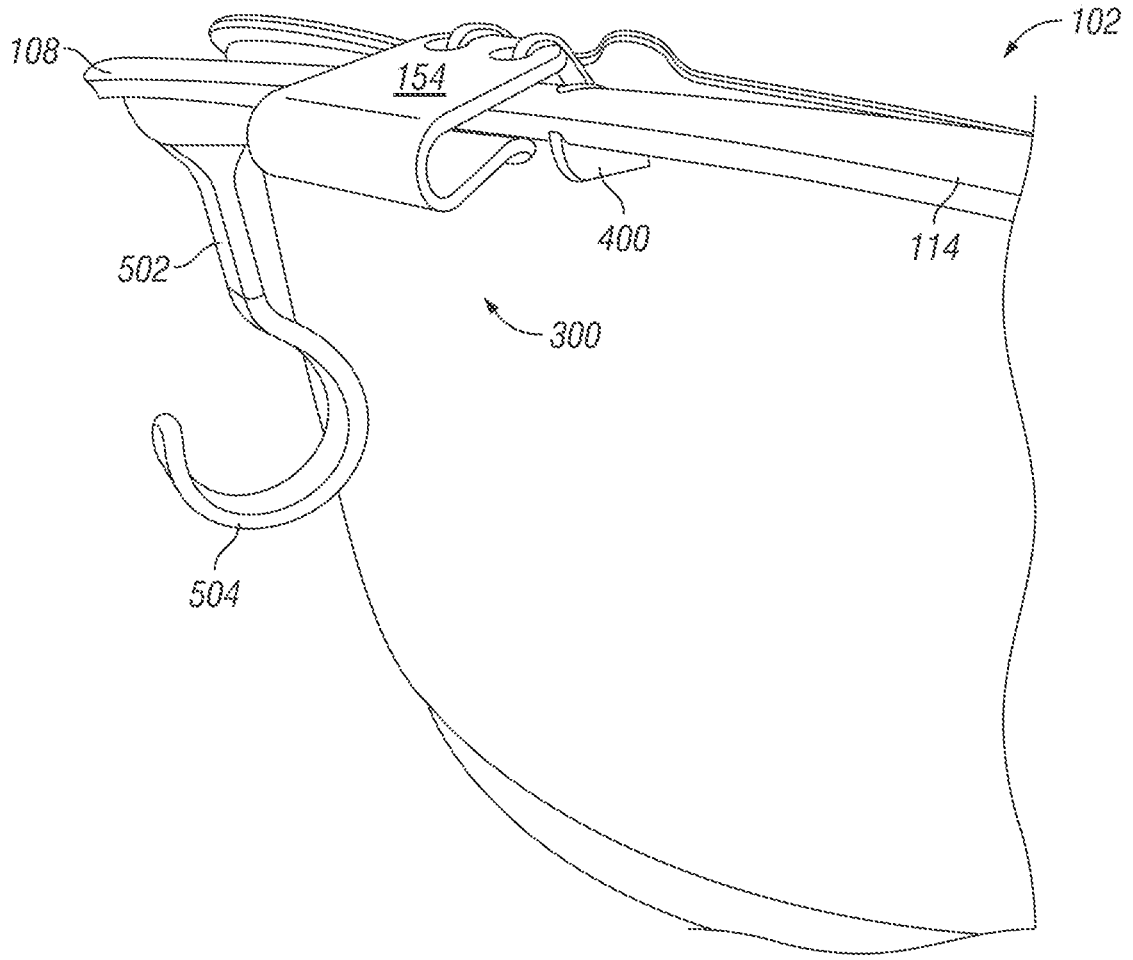
FIG. 9 is a side view detail of a fastener end hook and a storage hook, as installed or about to be installed on a rim of the tub.

In FIG. 9, a hook is being installed on rim 114 at hook position 300. The hook 154 has been positioned with the help of guide fins 400, in between which there is a space into which the hook 154 may fit. The user then pushes hook 154 onto rim 114 to complete this installation.

Figure 10:
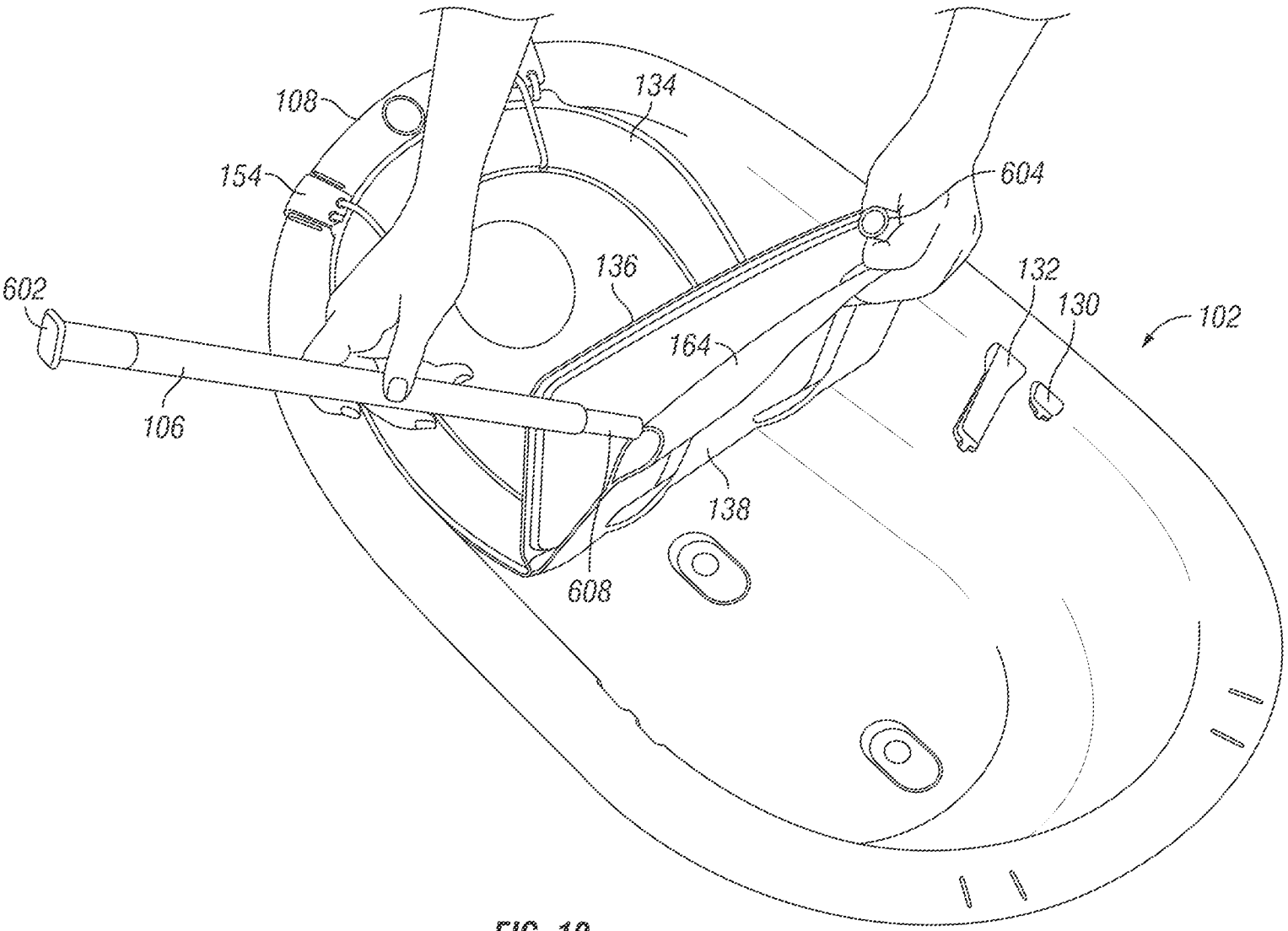
FIG. 10 is an illustration of a step of inserting the bar into a sling sleeve.

FIG. 10 illustrates a step in the assembly of the infant bathing system into either the first or second use configurations. One bar end 602 has been fitted onto the end of bar 106. Tube end 608 is about to be inserted into sleeve 164. After insertion, the user will fit the other bar end 604 onto tube end 608.

Figure 11:
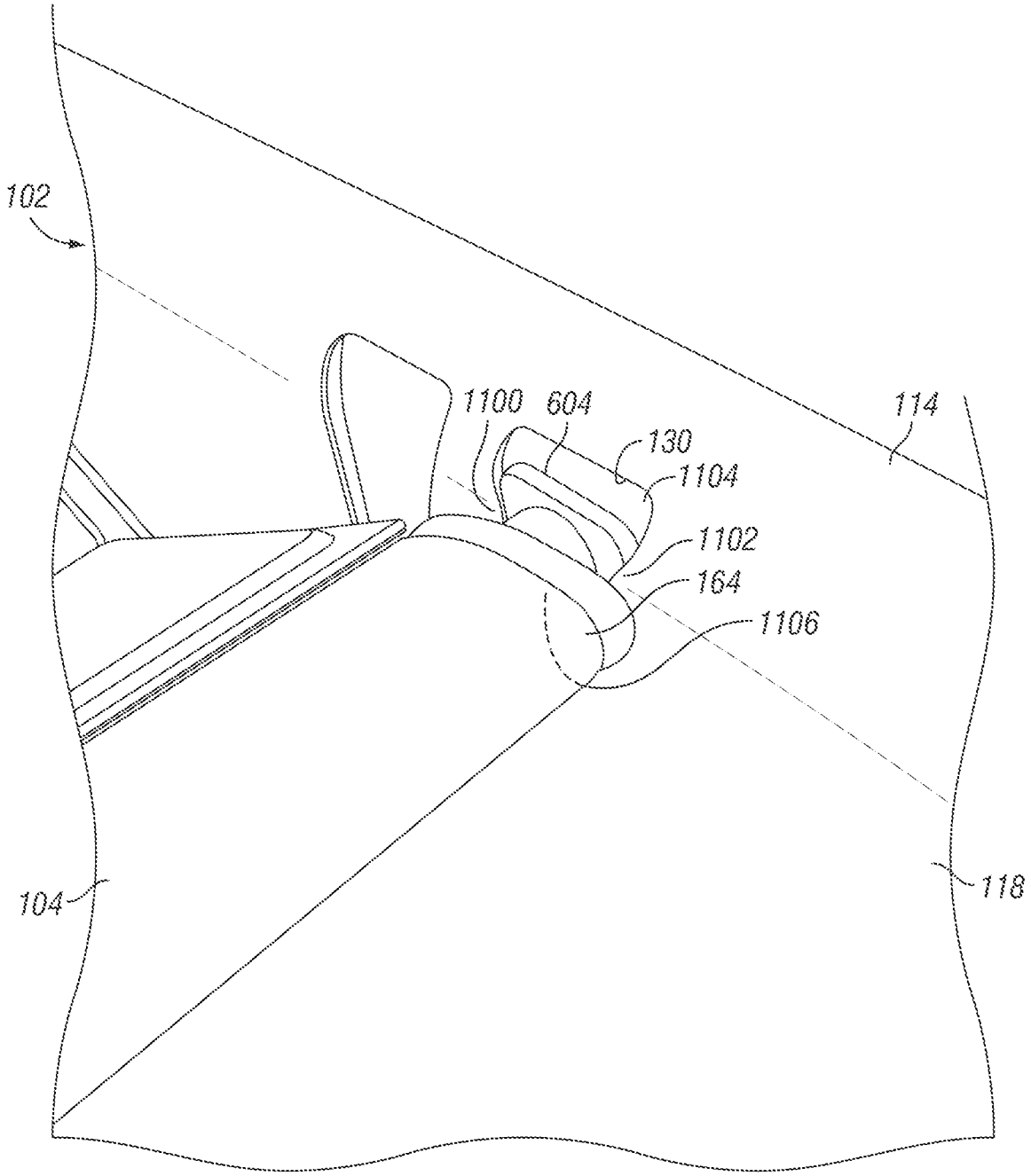
FIG. 11 is a perspective detail of a bar end as installed in a sidewall channel.
Figure 12:
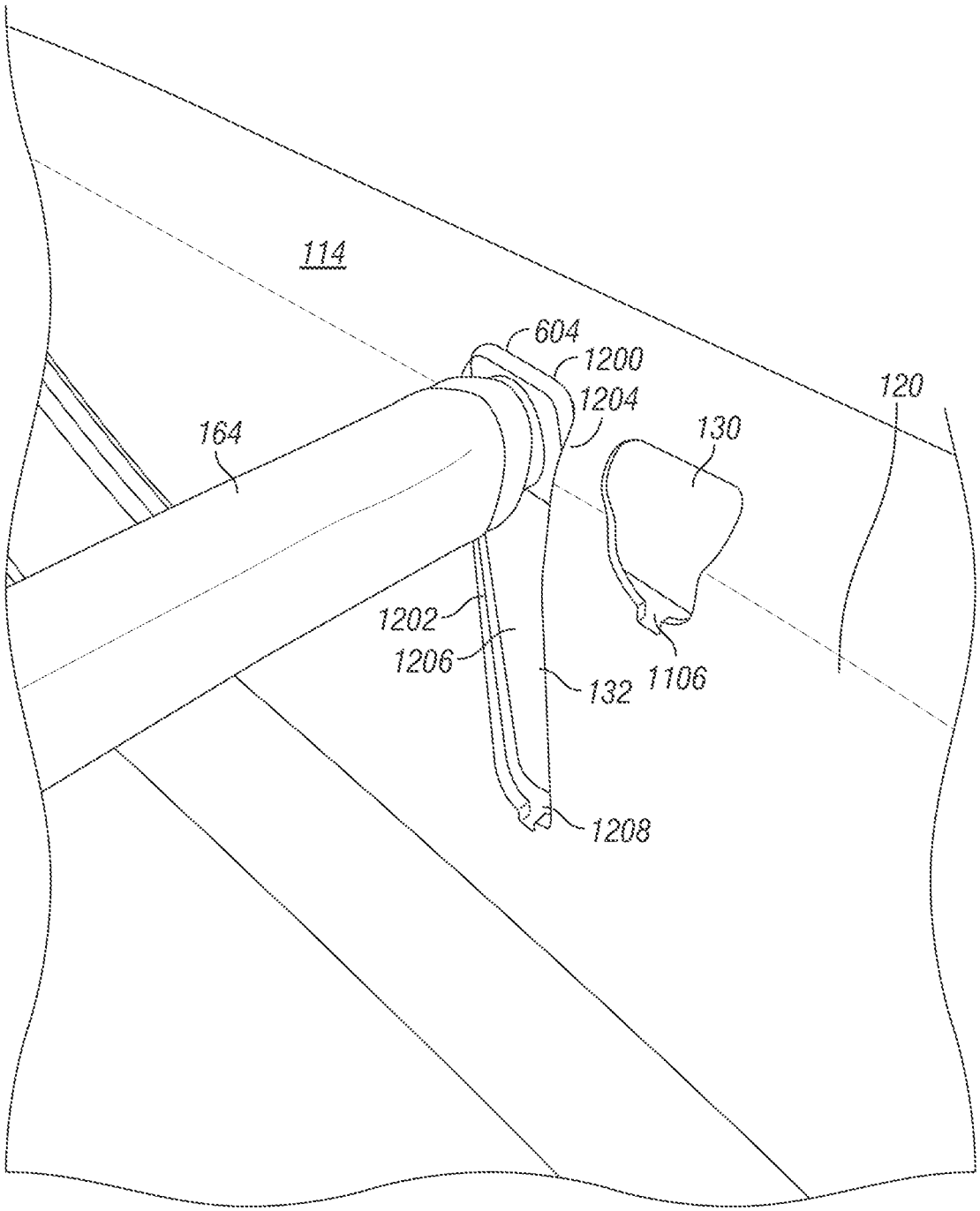
FIG. 12 is a perspective detail of a bar end being installed in another sidewall channel.

FIG. 11 is a detail of how a bar end 604 is inserted into a short channel 130, in the position that it would take in the first use configuration. The channel 130 has opposed flanges 1100, 1102 that are continuous with the sidewall 118. The flanges 1100, 1102 define a cavity 1104 into which the bar end 604 is inserted, and prevent bar end 604 from becoming dislodged. As can be seen in FIG. 12, a bottom 1106 of channel 130 is relatively high up on sidewall 118, such that sleeve 164 (FIG. 11) is supported at a relatively elevated position. Channel 200 is similarly shaped. In this embodiment, and in the first use configuration, the axis of the bar end 604 and sleeve 164 is positioned at about 3 cm from the top of rim 114.

Figure 13:
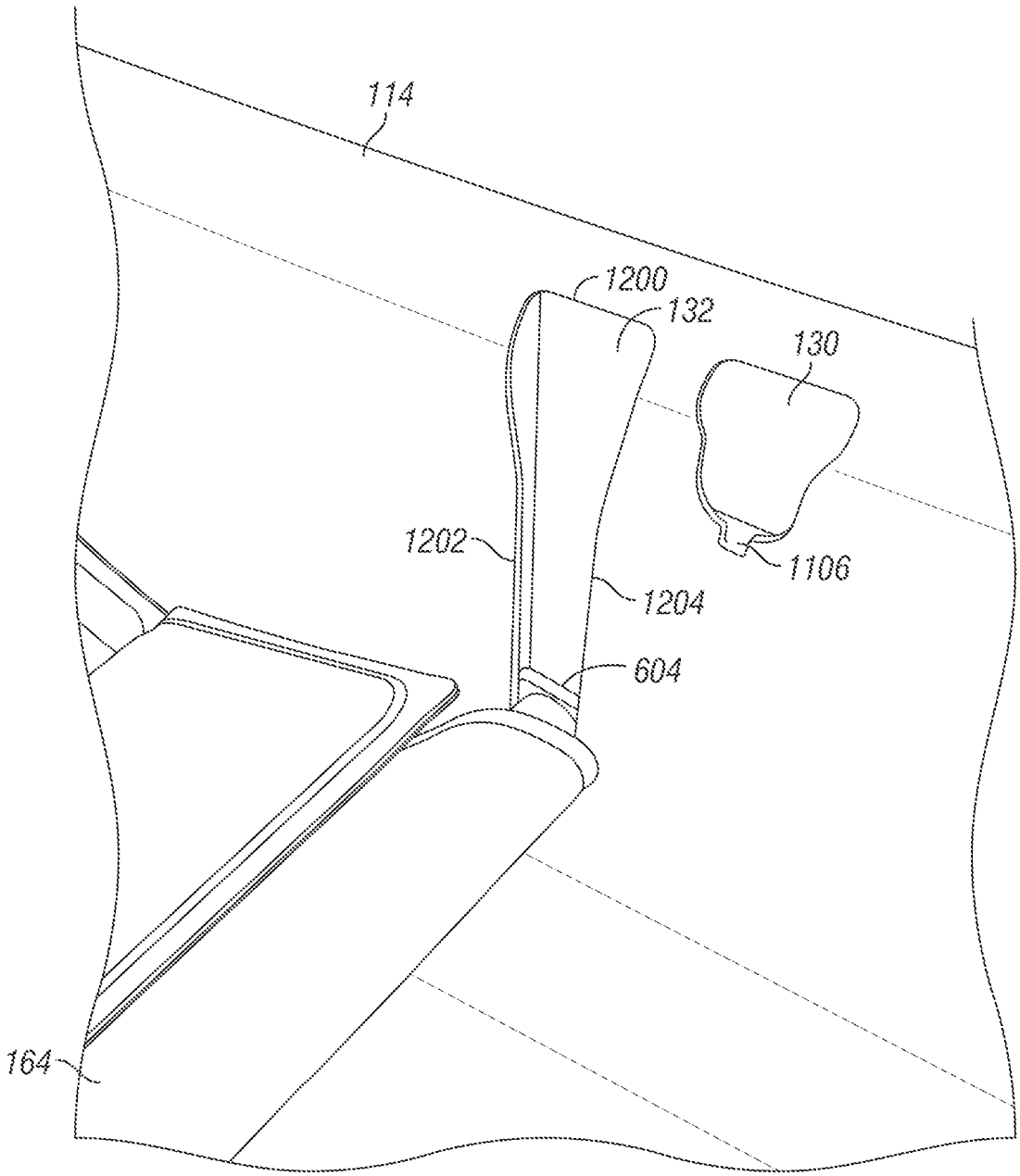
FIG. 13 is a perspective detail of a bar end seated at the bottom of the sidewall channel seen in FIG. 12.
Figure 14:
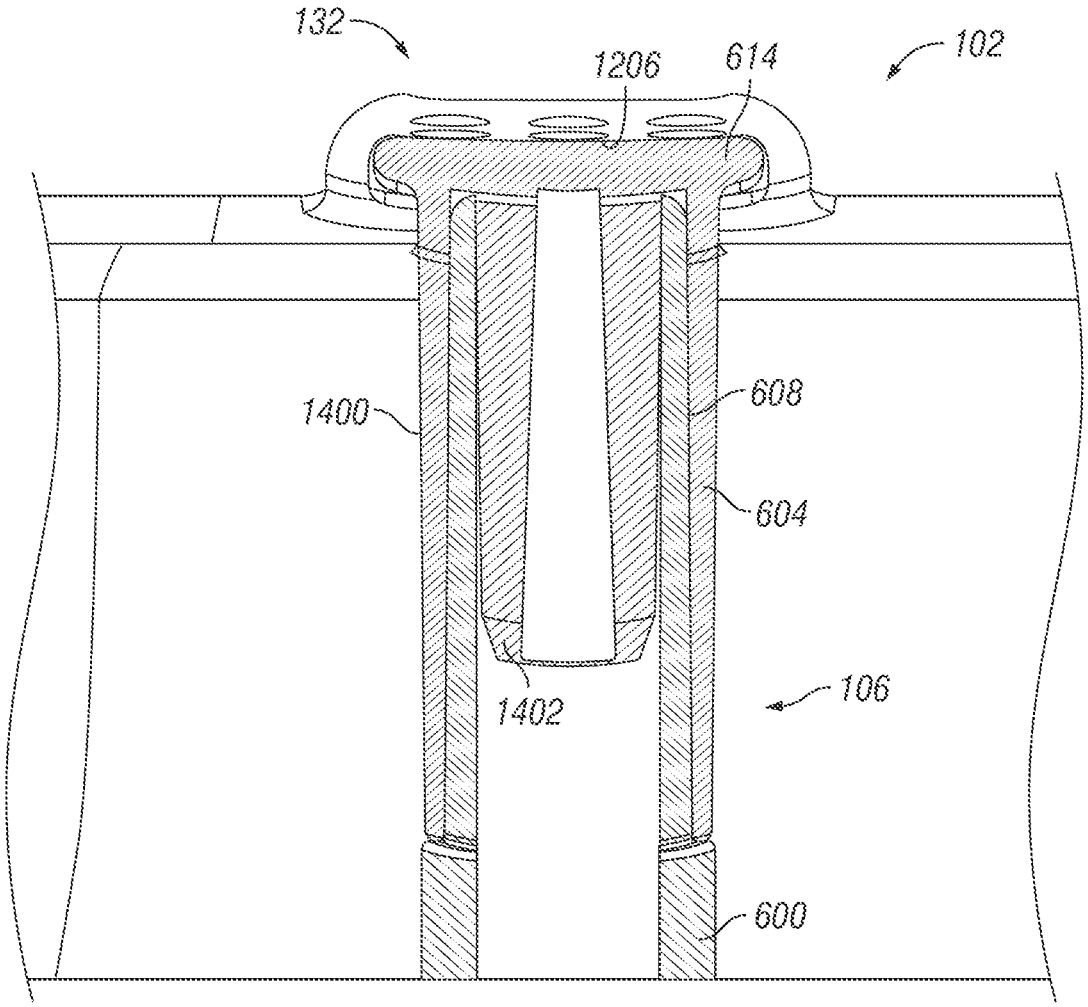
FIG. 14 is sectional detail of the bar end and channel as seen in FIG. 13.

FIG. 12 shows a step in the installation of bar end 604 into long channel 132, as would be done to configure the infant bathing system into a second use configuration. An upper end 1200 of the channel 132 is open and is positioned in or near rim 114. The channel 132 has opposed flanges 1202, 1204 which are continuous with sidewall 120 and which prevent bar end 604 from coming out. The flanges 1202, 1204 define a cavity 1206 in which the bar end 604 may downwardly slide, to bottom 1208. Channel 202 is formed similarly. FIG. 13 shows the position of bar end 604 after being slid down to bottom 1208, at which point it is substantially lower than the bottom 1106 of channel 130. In the sectional view of FIG. 14, it is seen that bar end 604 has an external wall 1400 and a plug insert 1402 that together define a space in which necked end 608 is fitted. The bar end flange 614 is sized to fit within channel cavity 1206. In the configuration shown in FIG. 13, the position of an axis of the sleeve 164 and the bar it encloses is about 11 cm from the top of rim 114, while still being upwardly displaced from the tub floor.

Figure 15A:
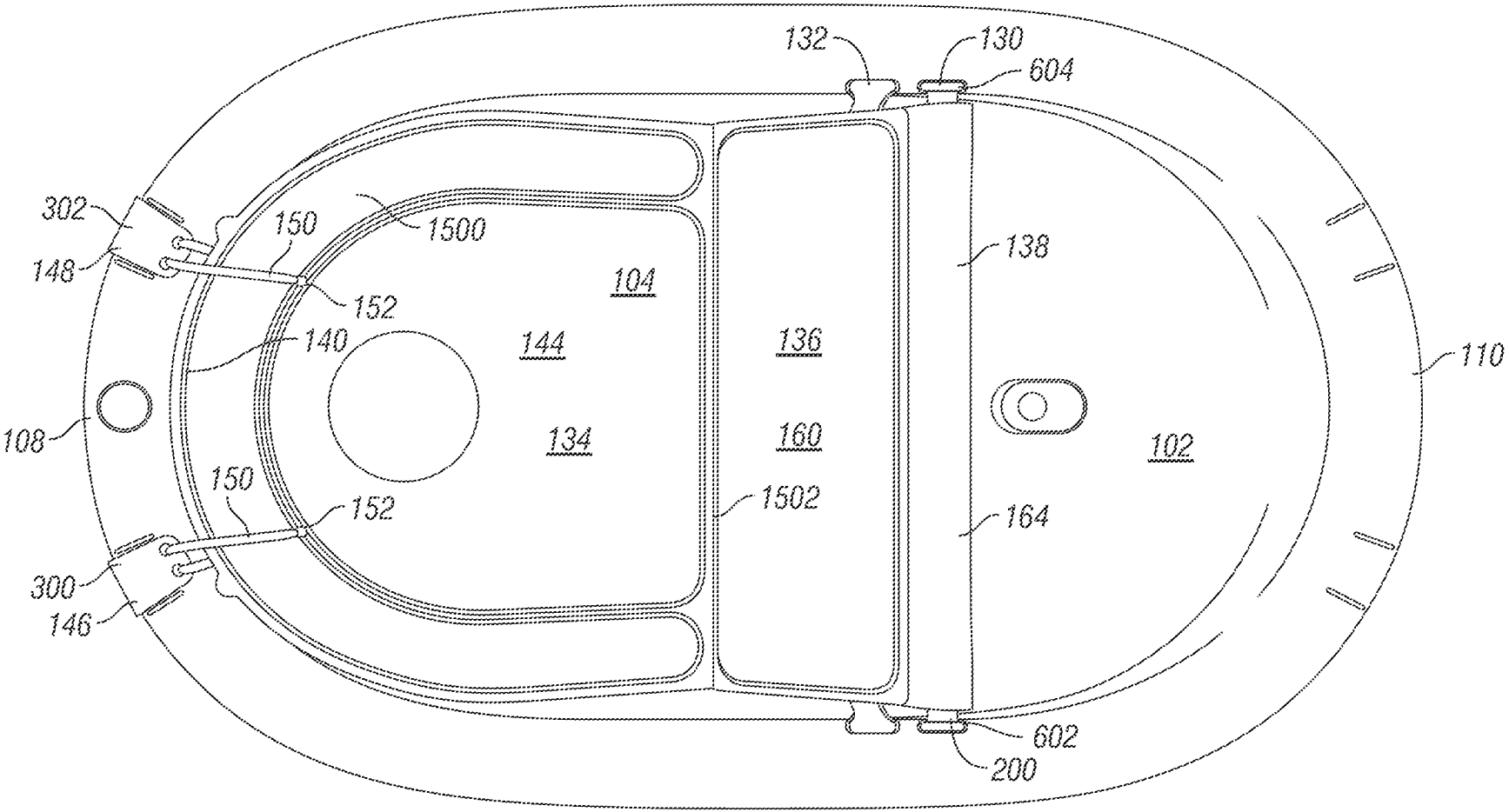
FIG. 15A is a top view of the infant bathing system in a first configuration, for bathing an infant from 0 to 3 months old.
Figure 15B:
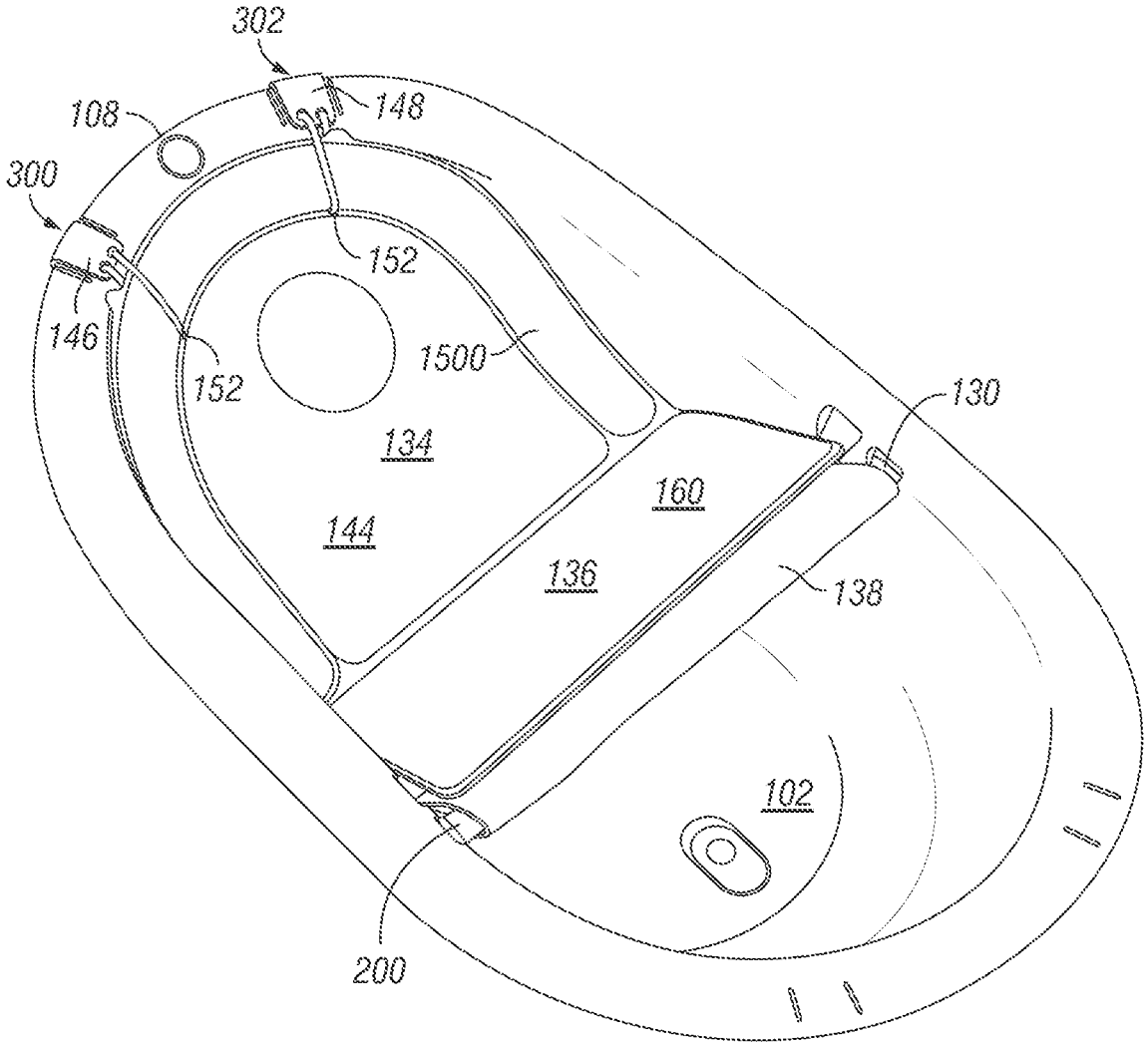
FIG. 15B is a top perspective view of the configuration shown in FIG. 15A.
Figure 15C:
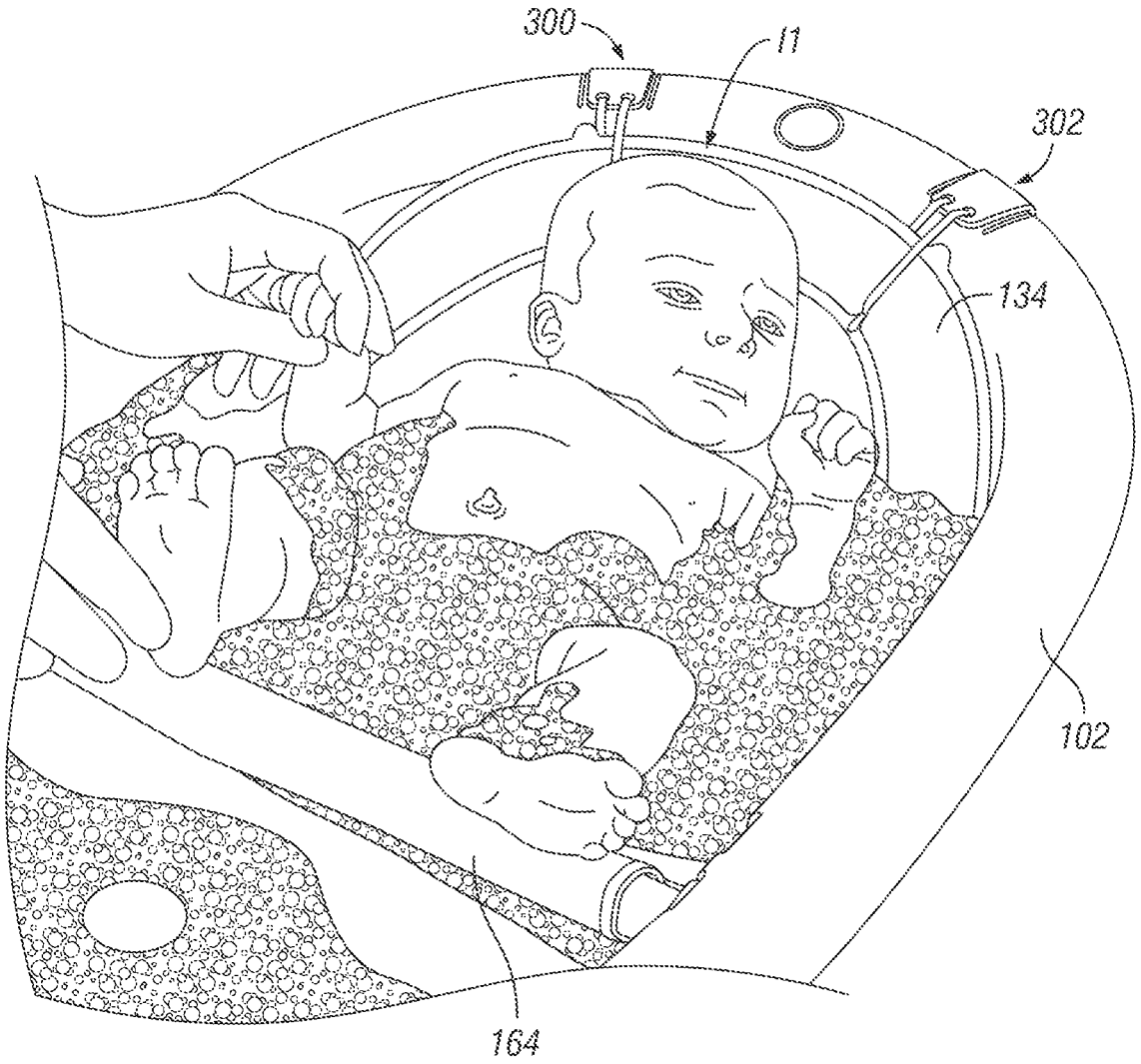
FIG. 15C is a top perspective view of the infant bathing system in its first configuration and as employed bathing an infant from 0 to 3 months old.

FIGS. 15A-15C illustrate the use of the infant bathing system in a first use configuration. This configuration is used for an infant I1 who is newborn, or aged from 0 to 3 months. The sling 104 is placed into tub 102 such that surfaces 144 and 160 of first and second panels 134, 136, respectively, face upwardly so as to receive the body of infant I1. Bar end 602 is inserted into short channel 200, while bar end 604 is inserted into short channel 130. The first end 140 of panel 134 is fastened to hook positions 300 and 302 using fasteners 146 and 148. Infant I1 is not much longer than sling 104 in this configuration and the infant I1 is supported at a relatively high position relative to the depth of the tub. It is also seen that the cord holes 152 are made to be positioned inwardly from an inner edge of a curved peripheral EVA foam pad 1500, thus providing additional resistance to the cords 150 pulling through the panel 134. First panel 134 is disposed so as to gently decline from end 108 toward the center. Panel 136 is tilted slightly upwardly, so that panels 134 and 136 together cradle the body of infant I1.

Panels 136 and 138 form a low point 1502 that will support the seat of the infant and which in this embodiment is located about 10 cm from the rim 114. Low point 1502 should be at or above the recommended fill level of the tub, which in this embodiment is about 5 cm. For example, low point 1502 can be about 55 mm above the tub floor 116, but this distance will be highly dependent on the weight of the supported infant I1 and the materials used to make up the sling panels. Panel 136 lies over and against panel 138, covering up most of it, including the leg holes (not visible here) formed in panel 138. In the illustrated embodiment, the low point 1502 of sling 104 is disposed below the vertical position of the bar and sleeve 164.

The first use configuration is intended to suspend infant I1 above the water in the tub, allowing for sponge bathing without submersion. The infant I1 is held by the sling 104 so that at least his or her navel is elevated above the water level in the tub, mitigating a source of potential infection.

Figure 16A:
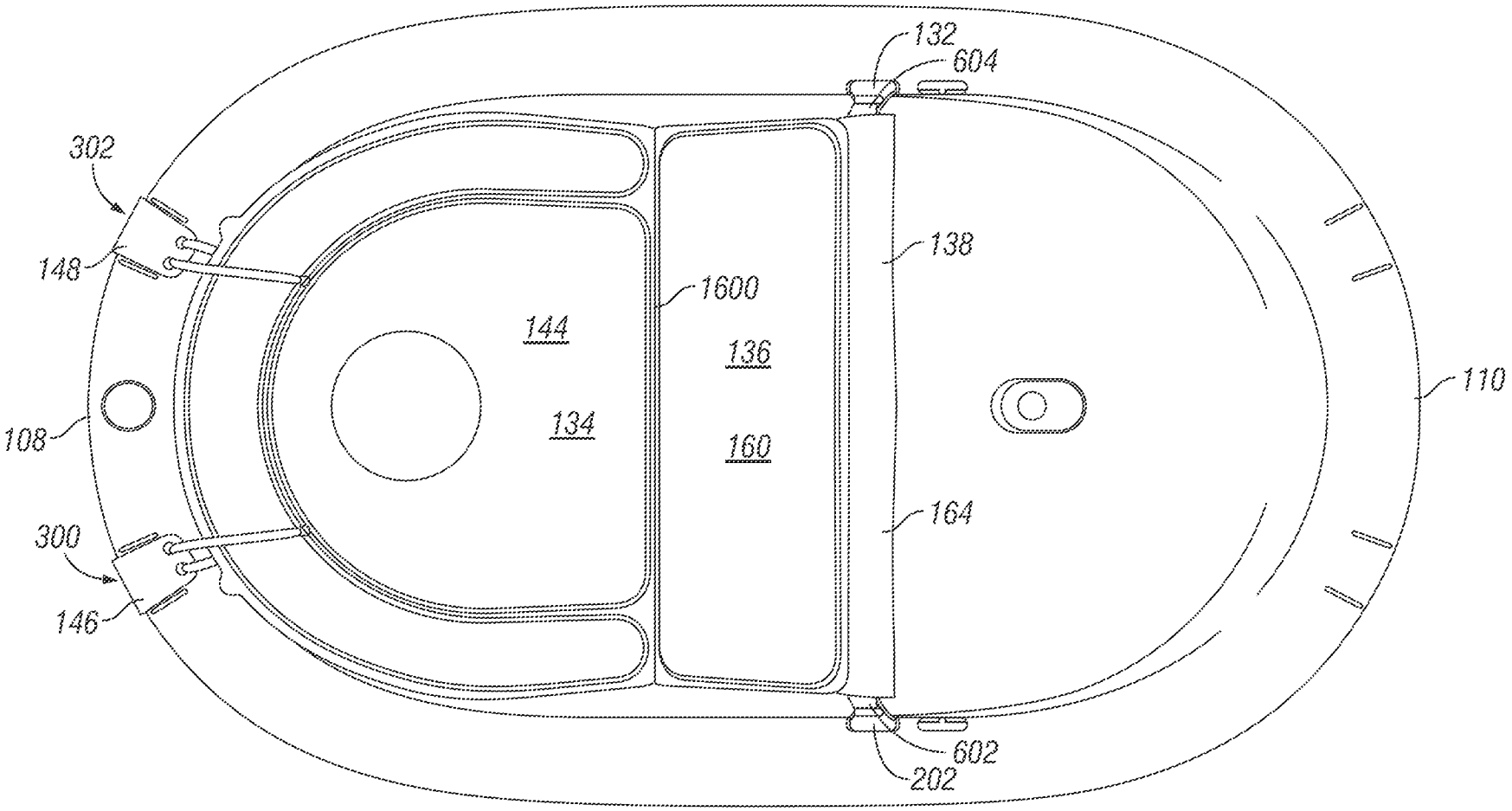
FIG. 16A is a top view of the infant bathing system in a second configuration, for bathing an infant from 3 to 6 months in age.
Figure 16B:
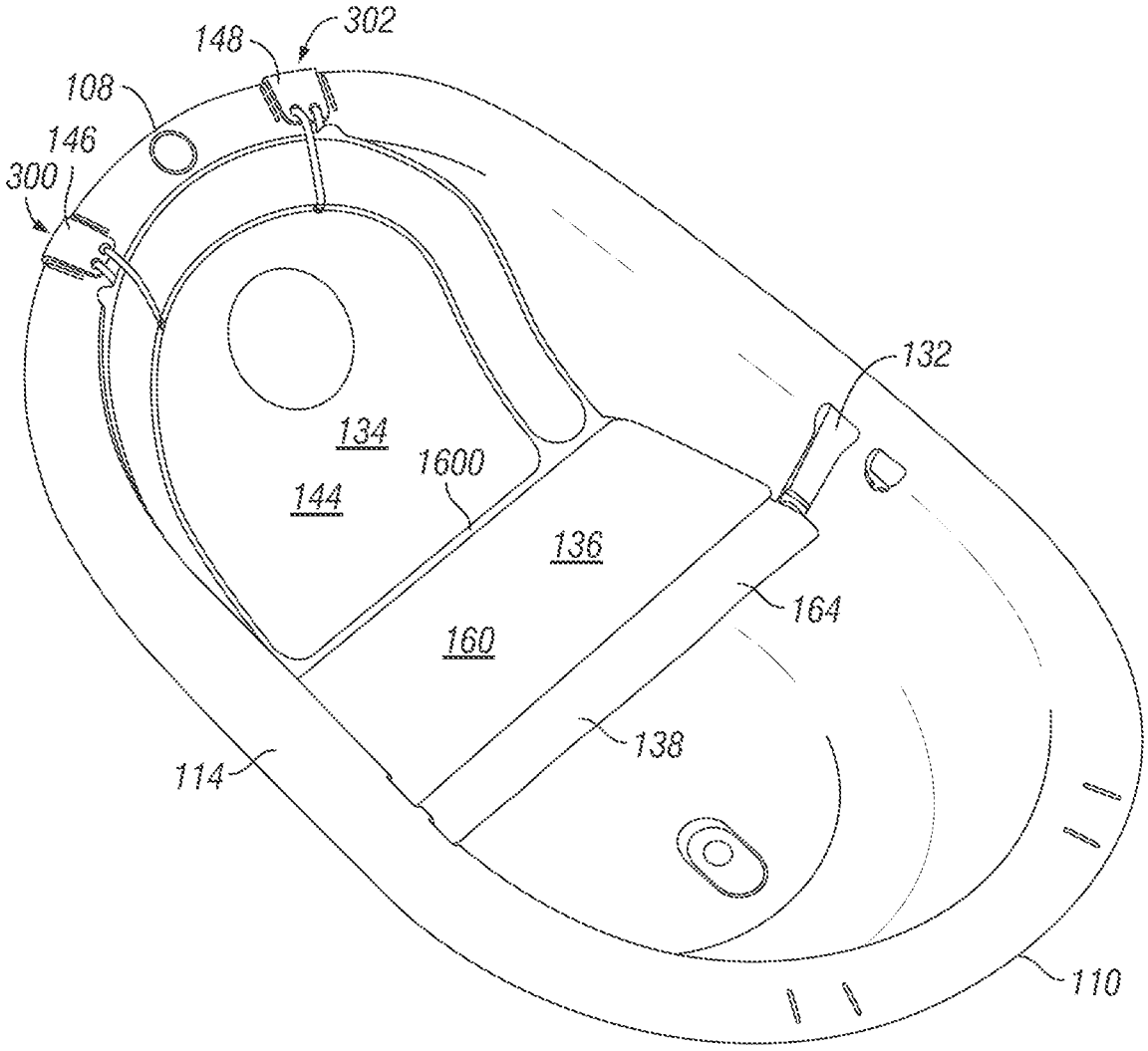
FIG. 16B is a top perspective view of the configuration shown in FIG. 16A.
Figure 16C:
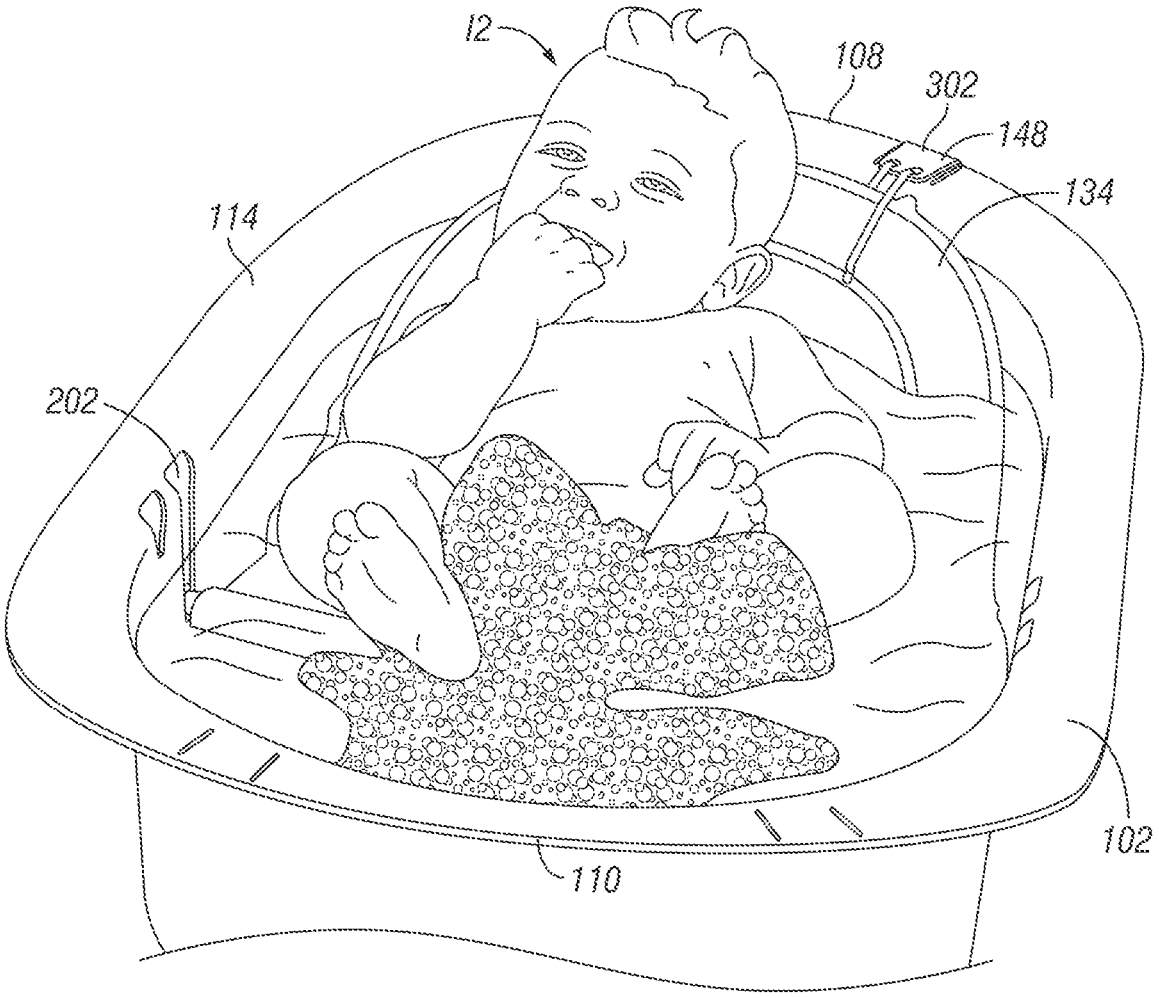
FIG. 16C is a top perspective view of the infant bathing system in its second configuration and as employed in bathing an infant from 3 to 6 months old.

FIGS. 16A-16C illustrate the use of the infant bathing system in a second use configuration. This configuration allows the infant to be submerged in water. In this configuration, the fasteners 146, 148 continue to be installed at hook positions 300 and 302, near tub end 108. But bar end 604 is inserted into channel 132, and bar end 602 is inserted into channel 202. This lowers sleeve 164 (and bar 106) and displaces it more toward end 108. Panel 134 is now more inclined and acts more like a chair back and panel 136 acts more like a chair seat. Panels 134 and 160 join at a low point 1600, which in the illustrated embodiment is somewhat below the vertical position of the bar and sleeve 164. Low point 1600 can, for example, be about 17 cm below the rim 114. In one embodiment, low point 1600 bottoms out on tub floor 116. This configuration is adapted to receive an infant 12, aged three to six months, who is considerably larger than infant I1. Infant 12 is suspended in tub 102 at a lower position than infant I1. More of infant 12's body is immersed in the bath water. Panel 136 continues to lie over and against panel 138, covering up most of it. Surfaces 144 and 160 continue to face upward.

Figure 17A:
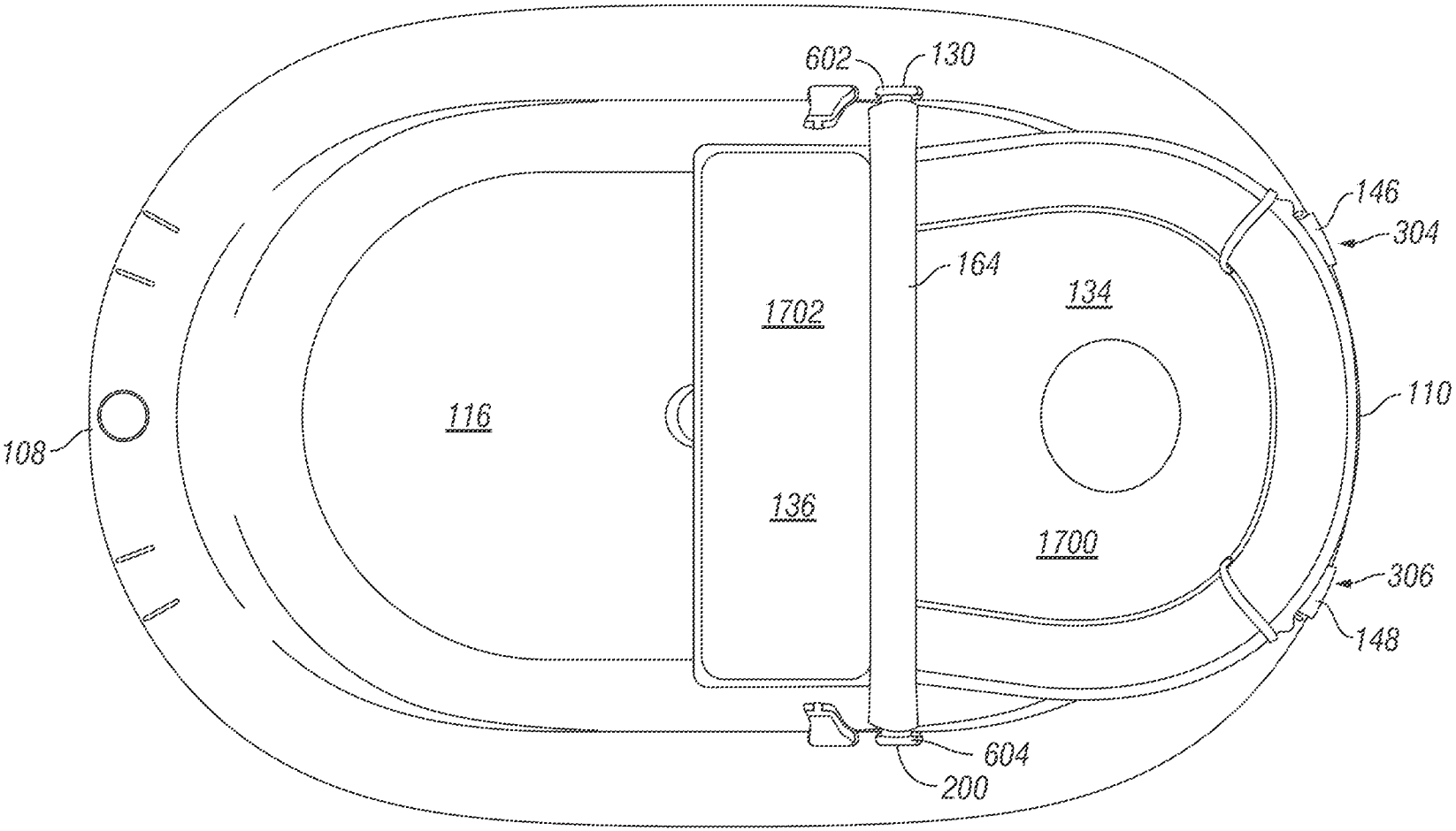
FIG. 17A is a top view of the infant bathing system in a third configuration, for bathing an infant from 6 to 9 months in age.
Figure 17B:
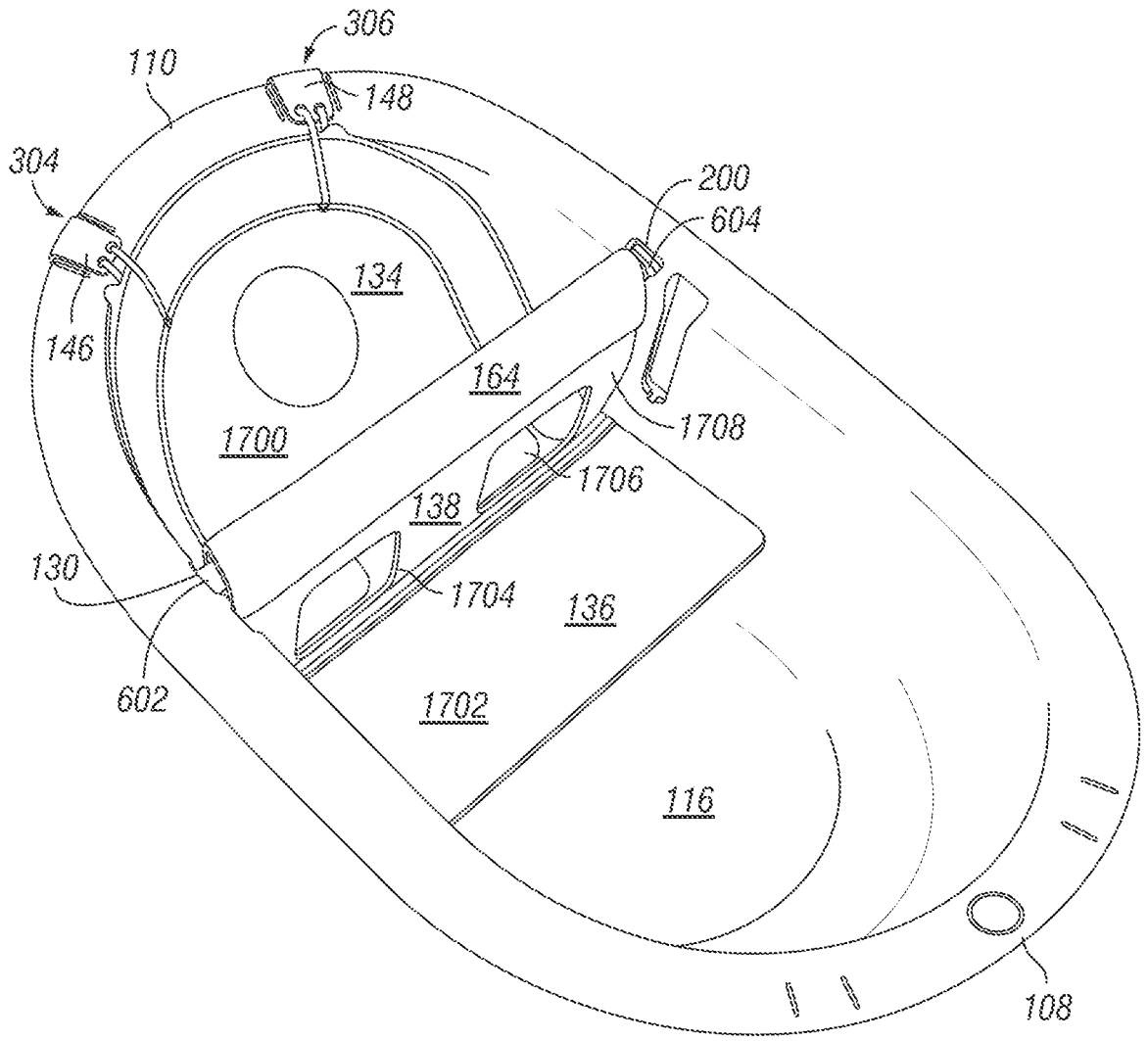
FIG. 17B is a top perspective view of the configuration shown in FIG. 17A.
Figure 17C:
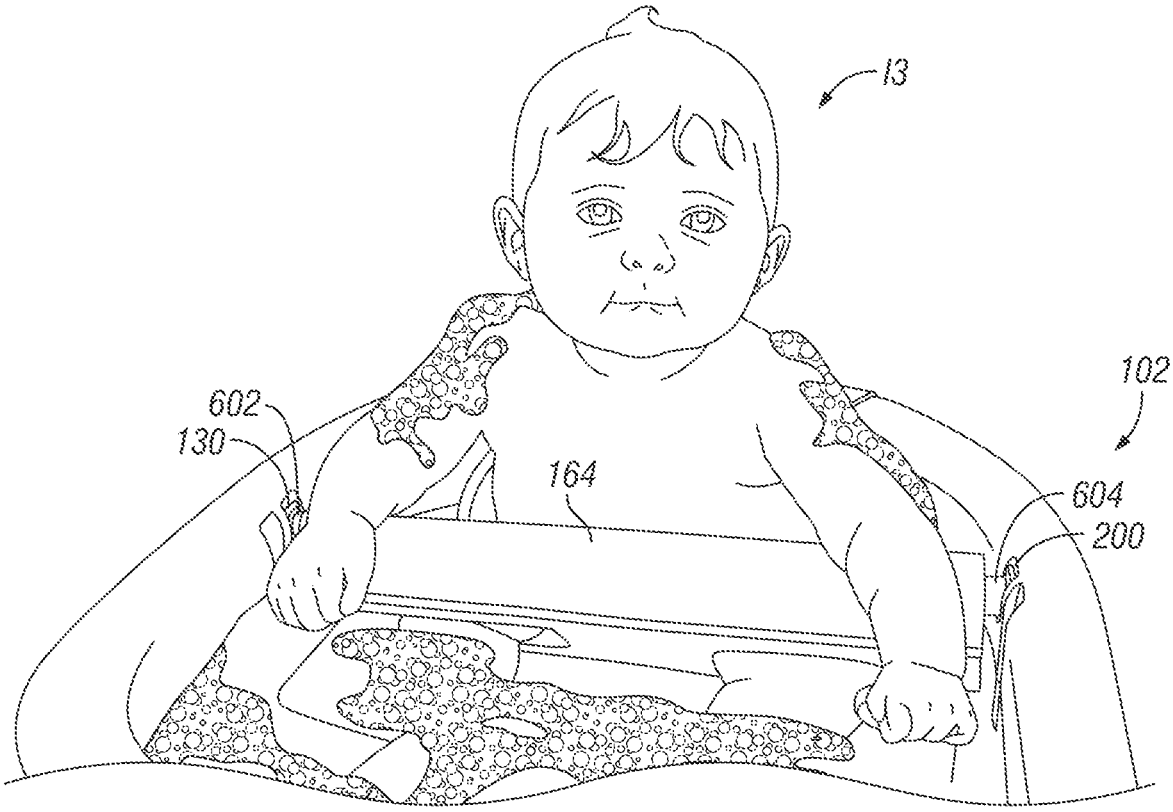
FIG. 17C is a top perspective view of the infant bathing system in its third configuration and as employed in bathing an infant from 6 to 9 months old.

FIGS. 17A-17C illustrate the use of the infant bathing system in a third use configuration. In this configuration, the sling 104 is turned upside down and is installed in tub 102 such that a second surface 1700 of panel 134 faces up, and such that a second surface 1702 of panel 136 faces up. The first surface 160 of panel 136 is facing the tub floor 116, to where it has fallen. Third panel 138 is disposed to be above panel 136. Third panel 138 has spaced-apart leg holes 1704, 1706 formed therein to extend from a first surface 1708 to the opposed surface 708 of panel 138 (FIG. 7).

The first end 140 of panel 134 is fastened to tub end 110 by fasteners 146 and 148, at hook positions 304 and 306, respectively. Bar end 602 is placed in short channel 130 while bar end 604 is placed in short channel 200.

In this configuration, an infant 13, aged six to nine months, is sitting up in a chairlike structure, with his or her legs extending through leg holes 1704 and 1706. The panel 134 is even more inclined than it was in the second configuration. Panel 136 in essence is not being used, and no longer occludes the leg holes 1704 and 1706 in panel 138, which therefore may be employed. Infant 13 is prevented from sliding down into tub 102 and infant 13's head and upper body are maintained in an upright position.

Figure 18:
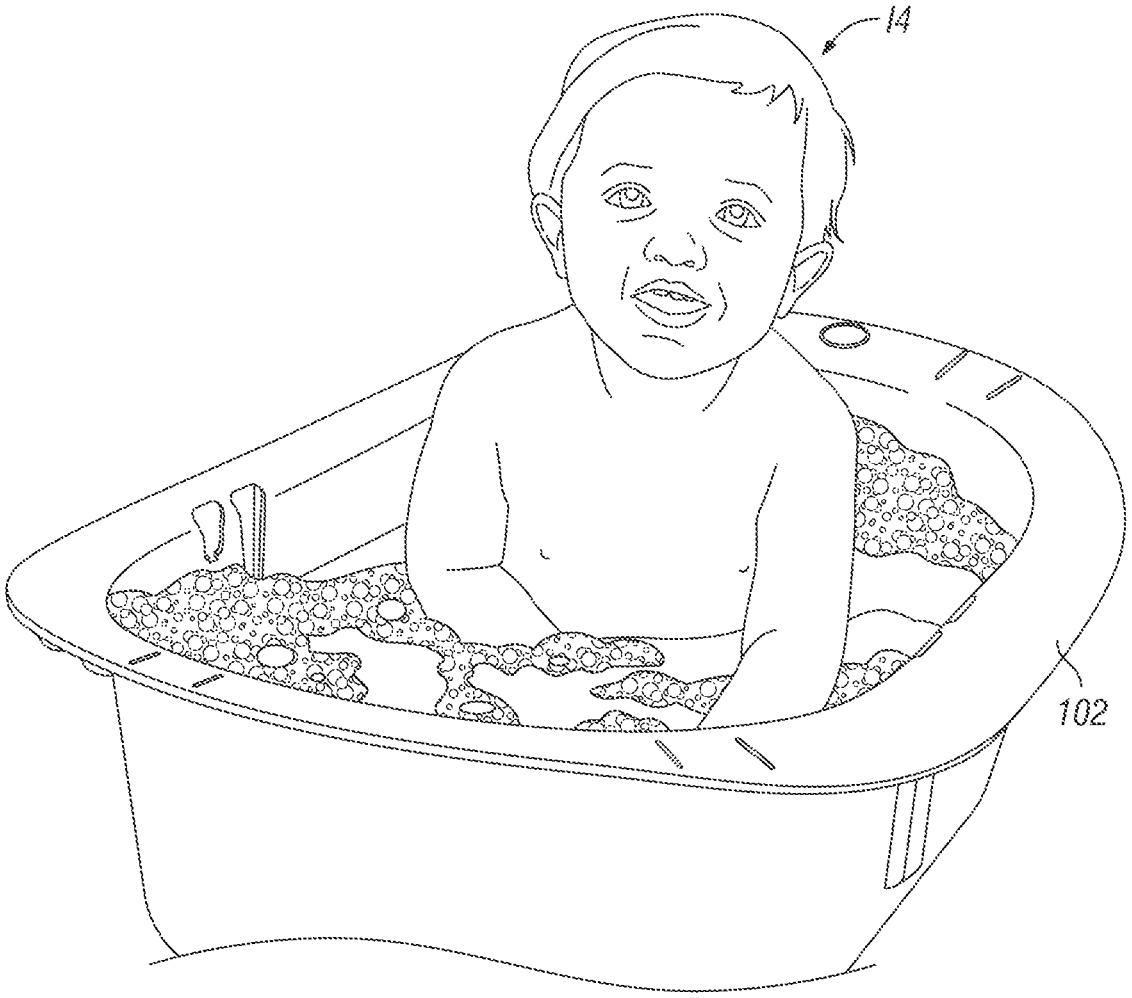
FIG. 18 is a top perspective view of the infant bathing system in a fourth configuration as employed in bathing an infant from 9 to 24 months old, and in which the sling is entirely removed.

Finally, FIG. 18 illustrates the use of the infant bathing system in a fourth configuration, suitable for an infant aged 9 to 24 months. In this configuration, the sling 104 is not used at all, and infant 14 simply sits in the tub 102.

In some less versatile embodiments, only one of the configurations shown in FIGS. 15A-15C and 16A-16C may be provided. Therefore, some of the claims hereof claim a "first configuration", which may be either exemplary configuration shown in FIG. 15A-15C or 16A 16C, and a "second configuration", an example of which is illustrated in FIGS. 17A-17C. Other claims recite a "first configuration" similar to that seen in FIGS. 15A-15C and a "second configuration", an example of which is illustrated in FIGS. 16A-16C. But in the illustrated embodiment, there are four use configurations in total.

In summary, a sling, and an infant bathing system, have been presented which may be configured and reconfigured for various ages of infants, from zero to 24 months. This extends the useful life of the bathing system and obviates the need to acquire other, substitute bathing apparatus as the child grows older.

While certain embodiments of the invention have been described in the above detailed description and/or illustrated in the accompanying drawings, the invention is not limited thereto but only by the scope and spirit of the claims.

We claim:

1. A convertible sling for supporting an infant, the sling comprising:

a first panel formed of flexible material and having a first end and an opposed second end, the first panel having a first surface and an opposed second surface; at least one fastener connected to the first end of the first panel for fastening the first end of the first panel to a support;

a second panel formed of flexible material and having a first end and an opposed second end, the second panel having a first surface and an opposed second surface, the first end of the second panel being joined to the second end of the first panel, the second end of the second panel being a free end; and a third panel formed of flexible material and having a first end and an opposed second end, the third panel having a first surface and an opposed second surface, first and second leg holes formed in the third panel to be spaced apart from each other and to extend through the third panel from the first surface of the third panel to the second surface of the third panel, the first end of the third panel being joined to the second end of the first panel and being joined to the first end of the second panel, an attachment mechanism connected to the second end of the third panel for attaching the second end of the third panel to a support; wherein in a first use configuration, the first surface of the first panel and the first surface of the second panel face upward to receive a body of an infant and the third panel is disposed below the second panel, and wherein, in a second use configuration, the second surface of the first panel faces upward to receive the body of the infant and the infant's legs are extended through the leg holes from the first surface of the third panel to the second surface of the third panel, the second panel then being disposed below the third panel.

2. The sling of claim 1, wherein in the first use configuration, the second panel is supported by the third panel, the second surface of the second panel lying against the first surface of the third panel so as to occlude the leg holes in the third panel.

3. The sling of claim 1, wherein the attachment mechanism comprises a flexible sleeve formed on the second end of the third panel, a rigid bar inserted through the sleeve, first and second bar ends laterally outwardly extending from the sleeve and adapted to be attached to respective supports.

4. The sling of claim 1, wherein the at least one fastener is one of spaced-apart first and second fasteners, each of the first and second fasteners having a free end terminating in a hook for fastening to a support.

5. The sling of claim 1, wherein the first and second panels are formed as a continuous piece of flexible material.

* * * * *